US012454867B2

(12) United States Patent
Bryant et al.

(10) Patent No.: US 12,454,867 B2
(45) Date of Patent: Oct. 28, 2025

(54) INTEGRATED WELLSITE PROCESSING SYSTEM AND WELLSITE MONITORING SYSTEM AND METHOD OF USING SAME

(71) Applicant: GR Energy Services Management, LP, Sugar Land, TX (US)

(72) Inventors: Cameron Michael Bryant, Sugar Land, TX (US); James William Anthony, Missouri City, TX (US); David Chesney, Houston, TX (US); Roma Montifar, Katy, TX (US); Tyler Chaney, Rosharon, TX (US); Andres C Villareal, Duncanville, TX (US); David M Headley, Manvel, TX (US); Julio C. Guerrero, Cambridge, MA (US); Jeffree Sea Dickinson, Sugar Land, TX (US)

(73) Assignee: GR Energy Services Management, LP, Sugar Land, TX (US)

( * ) Notice: Subject to any disclaimer, the term of this patent is extended or adjusted under 35 U.S.C. 154(b) by 0 days.

(21) Appl. No.: 18/271,444

(22) PCT Filed: Jan. 9, 2022

(86) PCT No.: PCT/US2022/011740
§ 371 (c)(1),
(2) Date: Jul. 7, 2023

(87) PCT Pub. No.: WO2022/150672
PCT Pub. Date: Jul. 14, 2022

(65) Prior Publication Data

US 2024/0060369 A1 Feb. 22, 2024

Related U.S. Application Data

(60) Provisional application No. 63/135,610, filed on Jan. 9, 2021.

(51) Int. Cl.
*E21B 19/16* (2006.01)

(52) U.S. Cl.
CPC ..... *E21B 19/165* (2013.01); *E21B 19/161* (2013.01)

(58) Field of Classification Search
CPC ..... E21B 19/165; E21B 19/161
See application file for complete search history.

(56) References Cited

U.S. PATENT DOCUMENTS 1,106,675 A 8/1914 Henry
6,142,041 A * 11/2000 Buck ..... E21B 19/165 81/57.35

(Continued)

FOREIGN PATENT DOCUMENTS

CN 203742568 7/2014
DE 102006039096 1/2008

(Continued)

OTHER PUBLICATIONS

International Search Report and Written Opinion dated May 13, 2022, pp. 1-11.

*Primary Examiner* — James G Sayre
(74) *Attorney, Agent, or Firm* — JL Salazar

(57) ABSTRACT

An integrated tool processing system and a wellsite monitoring system for a wellsite. The integrated tool processing system includes a tool assembler, a tool lift, and a tool transporter. The tool assembler includes a tool conveyor and a gun builder. The tool lift is connected by a tool stager to the tool assembler. The tool lift includes a lift base to receive the downhole tool and a lift arm to lift the downhole tool. The tool transporter includes a vehicle and a boom for connection to the downhole tool. The vehicle and the boom carry the downhole tool into position for delivery at the wellsite. The wellsite monitoring system includes wellsite sensors to collect wellsite data, wellsite monitors to receive (Continued)

and analyze the wellsite data, and a central station to collect and further analyze the wellsite data and to operate the tool processing system based on the combined wellsite data.

22 Claims, 16 Drawing Sheets

(56) References Cited

U.S. PATENT DOCUMENTS

| | | | | |
|---|---|---|---|---|
| 6,216,789 | B1 | 4/2001 | Lorsignol et al. | |
| 6,520,089 | B1 | 2/2003 | Avanci et al. | |
| 6,543,538 | B2 | 4/2003 | Tolman et al. | |
| 6,995,682 | B1 | 2/2006 | Chen et al. | |
| 7,896,083 | B2 | 3/2011 | Vickery | |
| 8,267,012 | B2 | 9/2012 | Peeters et al. | |
| 8,960,093 | B2 | 2/2015 | Preiss et al. | |
| 9,127,545 | B2 | 9/2015 | Kajaria et al. | |
| 9,206,675 | B2 | 12/2015 | Hales et al. | |
| 9,581,422 | B2 | 2/2017 | Preiss et al. | |
| 9,605,937 | B2 | 3/2017 | Eitschberger et al. | |
| 9,617,829 | B2 | 4/2017 | Dale et al. | |
| 9,822,618 | B2 | 11/2017 | Eitschberger | |
| 9,915,513 | B1 | 3/2018 | Zemla et al. | |
| 10,036,236 | B1 | 7/2018 | Sullivan et al. | |
| 10,309,199 | B2 | 6/2019 | Eitschberger | |
| 10,329,858 | B1 | 6/2019 | He et al. | |
| 10,365,079 | B2 | 7/2019 | Harrington et al. | |
| 10,507,433 | B2 | 12/2019 | Eitschberger et al. | |
| 11,053,757 | B2 | 7/2021 | Lubojasky, Jr. et al. | |
| 2003/0196798 | A1 | 10/2003 | Newman | |
| 2005/0189142 | A1* | 9/2005 | Garcia | E21B 47/12 175/24 |
| 2006/0278394 | A1 | 12/2006 | Stover | |
| 2008/0264649 | A1 | 10/2008 | Crawford | |
| 2010/0243325 | A1* | 9/2010 | Veeningen | E21B 19/02 175/40 |
| 2011/0030942 | A1 | 2/2011 | Orgeron | |
| 2013/0076907 | A1 | 3/2013 | Hobbs et al. | |
| 2013/0138254 | A1 | 5/2013 | Seals et al. | |
| 2014/0033939 | A1 | 2/2014 | Priess et al. | |
| 2014/0126979 | A1* | 5/2014 | Hill | E21B 19/143 414/800 |
| 2014/0234059 | A1 | 8/2014 | Thomeer | |
| 2016/0061572 | A1 | 3/2016 | Eitschberger et al. | |
| 2016/0115753 | A1 | 4/2016 | Frazier et al. | |
| 2016/0208566 | A1 | 7/2016 | Bowley et al. | |
| 2016/0356432 | A1 | 12/2016 | Scribante et al. | |
| 2016/0376808 | A1 | 12/2016 | Magnuson et al. | |
| 2017/0030693 | A1 | 2/2017 | Preiss et al. | |
| 2017/0044875 | A1* | 2/2017 | Hebebrand | E21B 47/13 |
| 2017/0074078 | A1 | 3/2017 | Eitschberger | |
| 2018/0038208 | A1 | 2/2018 | Eitschberger | |
| 2018/0224260 | A1 | 8/2018 | Zemla et al. | |
| 2018/0299239 | A1 | 10/2018 | Eitschberger et al. | |
| 2019/0086189 | A1 | 3/2019 | Eitschberger et al. | |
| 2019/0127290 | A1 | 5/2019 | Löhken et al. | |
| 2019/0178045 | A1 | 6/2019 | Frazier et al. | |
| 2019/0211664 | A1 | 7/2019 | Billingham et al. | |
| 2019/0234189 | A1 | 8/2019 | Preiss | |
| 2019/0242222 | A1 | 8/2019 | Eitschberger | |
| 2019/0330947 | A1 | 10/2019 | Mulhern et al. | |
| 2019/0376775 | A1 | 12/2019 | Preiss et al. | |
| 2020/0024935 | A1 | 1/2020 | Eitschberger et al. | |
| 2020/0048996 | A1 | 2/2020 | Anthony et al. | |
| 2020/0072029 | A1 | 3/2020 | Anthony et al. | |
| 2020/0088005 | A1 | 3/2020 | Brunty et al. | |
| 2020/0224508 | A1* | 7/2020 | Chapman | E21B 47/008 |
| 2020/0277837 | A1 | 9/2020 | Hern et al. | |
| 2021/0002995 | A1* | 1/2021 | Botnan | E21B 19/155 |
| 2021/0039354 | A1 | 2/2021 | Tokuda et al. | |
| 2021/0398354 | A1 | 12/2021 | Konchenko et al. | |
| 2024/0060369 | A1 | 2/2024 | Bryant et al. | |

FOREIGN PATENT DOCUMENTS

| | | | |
|---|---|---|---|
| WO | 1979000704 | | 9/1979 |
| WO | 2009023042 | A1 | 2/2009 |
| WO | 2014028317 | A1 | 2/2014 |
| WO | 2022150670 | A1 | 7/2022 |
| WO | 2023132836 | A1 | 7/2023 |

* cited by examiner

INTEGRATED WELLSITE PROCESSING SYSTEM AND WELLSITE MONITORING SYSTEM AND METHOD OF USING SAME

CROSS-REFERENCE TO RELATED APPLICATIONS

This application claims the benefit of U.S. Patent Application No. 63/135,910 entitled "Wellbore Gun Builder with Gun Chucks and Method of Using Same" filed on Jan. 9, 2021, the entire contents of which is hereby incorporated by reference herein to the extent not inconsistent with the present disclosure. Applicant is the owner of PCT Patent Application No. PCT/US22/11739 entitled "Wellsite Monitoring System with Wellsite Tracker and Method of Using Same" and PCT Patent Application No. PCT/US22/11740 entitled "Wellbore Gun Builder with Gun Chucks and Method of Using Same" filed on the same day herewith, the entire contents of which are hereby incorporated by reference herein to the extent not inconsistent with the present disclosure.

BACKGROUND

The present disclosure relates generally to oilfield technology. More specifically, the present disclosure relates to techniques for assembling, delivering, and monitoring oilfield equipment.

Wellsite operations are performed to locate and access subsurface targets, such as valuable hydrocarbons. Drilling equipment is positioned at the surface and a downhole drilling tool is advanced into the subsurface formation to form a wellbore. Once drilled, casing may be inserted into the wellbore and cemented into place to complete a well. Once the well is completed, production equipment may be deployed into the wellbore to facilitate production of fluid to the surface for capture.

Various equipment may be used to perform the wellsite operations. Examples of equipment used at wellsites are provided in Patent/Application Nos. US2020/0072029, US2006/0278394, U.S. Ser. No. 10/329,858, WO2014028317, U.S. Pat. Nos. 6,216,789, 6,995,682, US2013/0138254, and U.S. Pat. No. 9,127,545, the entire contents of which is hereby incorporated by reference herein to the extent not inconsistent with the present disclosure. The equipment may include, for example, downhole drilling and other tools deployed into the earth. Examples of downhole tools are provided in US Patent/Application Nos. 2020/0024935; 10507433; 10,036,236; 2020/0072029; US2020/0048996; 2016/0115753; 2020/0277837; 20190376775; 20190330947; 20190242222; 20190234189; 10309199; 20190127290; 20190086189; 20180299239; 20180224260; 9915513; 20180038208; 9822618; 9605937; 20170074078; 9581422; 20170030693; 20160356432; 20160061572; 8960093; 20140033939; 8267012; 6520089; 20160115753; 20190178045; and 10365079, the entire contents of which is hereby incorporated by reference herein to the extent not inconsistent with the present disclosure. The downhole tools may be made of multiple components assembled together. Examples of assembly techniques are provided in U.S. Pat. Nos. 7,896,083; 11,066,75: and 9,581,422, the entire contents of which is hereby incorporated by reference herein to the extent not inconsistent with the present disclosure.

Various devices may be used with the equipment at the wellsite. For example, devices are used to move the equipment to a desired location. Examples of such devices are provided in Patent/Application Nos. U.S. Pat. Nos. 6,543,538, 9,617,829, WO2009/023042, WO2014028317, and U.S. Pat. No. 6,216,789 the entire contents of which is hereby incorporated by reference herein to the extent not inconsistent with the present disclosure. Devices are also used to collect measurements at the wellsite. Examples of such devices are provided in Patent/Application Nos. US2019/0211664 and US20080264649, the entire contents of which is hereby incorporated by reference herein to the extent not inconsistent with the present disclosure.

Despite the advancements in downhole technology, there remains a need for efficient techniques for reliably assembling, delivering, and monitoring equipment for use at the wellsite. The present disclosure is directed at providing such needs.

SUMMARY

In at least one aspect, the disclosure relates to a tool processing system. The tool processing system comprises a tool assembler; a tool stager; a tool lift; and a tool transporter. The tool assembler comprises a gun builder.

In another aspect, the disclosure relates to a method of processing tools. The method comprises assembling a downhole tool; staging the downhole tool; lifting the downhole tool; and transporting the downhole tool to a wellsite.

In yet another aspect, the disclosure relates to a wellsite system. The wellsite system comprises the tool processing system and a wellsite monitoring system coupled to the tool processing system to process tool parameters received therefrom. The tool monitoring system comprises sensors and monitors. The sensors comprise a well tracker.

Finally, in another aspect, the disclosure relates to a method of monitoring a wellsite. The method comprises collecting processing parameters from processing sensors positioned about the tool processing system; collecting wellsite parameters from wellsite sensors positioned about the wellsite; generating a wellsite analysis of wellsite operations based on the processing parameters and the wellsite parameters; and adjusting the tool operations and/or the wellsite operations based on the wellsite analysis.

The processing sensors comprise a wellsite tracker, and the collecting processing parameters comprises collecting location parameters from the wellsite tracker. The method further comprises generating a processing analysis of processing operations based on the processing parameters, the location parameters, and the wellsite parameters; and adjusting the processing parameters based on the processing analysis.

In yet another aspect, the disclosure relates to a method of monitoring wellsite operations. The method involves positioning a tool processing system at a wellsite, the tool processing system comprising a tool assembler, a tool stager, a tool lift, and a tool transporter; assembling a downhole tool with the tool assembler; staging the downhole tool with the tool stager; lifting the downhole tool with the tool lift; and transporting the downhole tool to a well with the tool transporter. The method may also involve storing tool components. The method further involves collecting tool parameters (e.g., location) from processing sensors positioned about a tool processing system, collecting wellsite parameters from wellsite sensors positioned about the wellsite at a central station, generating a processing analysis of processing operations based on the processing parameters and the wellsite parameters, and adjusting the processing operations and/or the wellsite operations based on the wellsite analysis.

The disclosure also relates to a tool processing system, a wellsite system, a wellsite monitoring system, methods of processing tools, and methods of monitoring wellsite operations as described herein.

In at least one aspect, the disclosure relates to an integrated tool processing system for processing a downhole tool at a wellsite. The integrated tool processing system comprises a tool assembler, a tool lift, and a tool transporter. The tool assembler comprises assembly equipment positioned at the wellsite. The assembly equipment comprises a tool conveyor and a gun builder positioned along the tool conveyor. The gun builder comprises gun chucks to threadedly connect portions of the downhole tool together. The tool lift is operatively connected by a tool stager to the tool assembler. The tool stager comprises a staging conveyor connected between the tool conveyor and the tool lift to transfer the downhole tool therebetween. The tool lift comprises a lift base to receive the downhole tool and a lift arm. The lift arm is movably positionable at an angle to the lift base whereby the downhole tool is lifted about the lift base. The tool transporter comprises a vehicle positionable about the wellsite and a boom extending above the vehicle. The boom is positionable about the lift arm and connectable to the downhole tool. The vehicle and the boom carry the downhole tool into position for delivery at the wellsite.

In another aspect, the disclosure relates to a method of processing downhole tools for use at a wellsite. The method comprises assembling a downhole tool by: passing portions of the downhole tool along an assembly conveyor and into a gun builder; and threadedly connecting the portions of the downhole tool using the gun builder; passing the downhole tool from the gun builder to a tool lift by passing the downhole tool from the assembly conveyor to the tool lift via a tool stager; lifting the downhole tool at an angle using the tool lift; and transporting the downhole tool from the tool lift to a wellsite.

In yet another aspect, the disclosure relates to a wellsite monitoring system for monitoring wellsite equipment at a wellsite. The wellsite monitoring system comprises wellsite sensors positioned about the tool processing system to collect wellsite data; wellsite monitors positioned about the wellsite, and a central station. The wellsite monitor coupled to the wellsite sensors to receive wellsite data therefrom. The wellsite monitors comprise monitor processors to generate monitor outputs based on the wellsite data. The central station is positioned at the wellsite. The central station is coupled to the wellsite monitors to receive the wellsite data and the generated outputs therefrom. The central station comprises a central processor to generate central outputs based on the monitor outputs and the wellsite data.

Finally, in another aspect, the disclosure relates to a method of monitoring wellsite operations at a wellsite. The method comprises collecting tool parameters from tool sensors positioned about the tool processing system; collecting wellsite parameters from wellsite sensors positioned about wellsite equipment at the wellsite; generating a tool analysis of processing operations based on the tool parameters, the tool analysis comprising a location of the downhole tool over time; generating a wellsite analysis based on the tool parameters and the wellsite parameters; and performing processing operations based on the wellsite analysis.

In at least one aspect, the present disclosure relates to a wellbore gun builder, comprising: a feed assembly and a chuck assembly. The feed assembly comprises a conveyor assembly and a linear actuator. The chuck assembly comprises a rotating gun chuck, an axial gun chuck, and chuck jaws.

In another aspect, the present disclosure relates to a method of building a wellbore gun, comprising: feeding gun components of the wellbore gun along a feed assembly and into a build assembly; and selectively connecting the gun components of the wellbore gun with chucks of the build assembly. The method may involve feeding a first gun carrier, a gun sub, and a second gun into a chuck assembly with the gun sub positioned between the first gun carrier and the second gun carrier, gripping the first gun carrier with an axial gun chuck of the chuck assembly, gripping the second gun carrier with a rotating gun chuck of the chuck assembly, and securing the gun sub to the first gun carrier and the second gun carrier by: applying a torque to rotate rotating gun chuck; and allowing the axial gun chuck to move axially about the rotating gun chuck.

In at least one aspect, the present disclosure relates to a chuck assembly for assembling a wellbore gun. The chuck assembly comprises a chuck housing, a rotating gun chuck, and an axial gun chuck. The rotating gun chuck is positioned in the chuck housing and rotationally movable thereabout. The rotating gun chuck has a first hole therethrough. The rotating gun comprises chuck jaws radially movable about the first hole in the rotating chuck to selectively grip a portion of the wellbore gun. The axial gun chuck is positioned in the chuck housing and axially movable thereabout, the axial gun chuck having a second hole therethrough. The axial gun chuck comprises chuck jaws radially movable about the second hole in the axial gun chuck to selectively grip another portion of the wellbore gun. The second hole of the axial gun chuck aligned with the first hole of the rotating gun chuck to define a passage for receiving the wellbore gun therethrough. The rotating gun chuck is rotationally positioned about the axial gun chuck to selectively rotate the portion of the wellbore gun as the axial gun chuck moves axially about the chuck housing whereby the portion of the wellbore gun is threadedly connected to the another portion of the wellbore gun.

In another aspect, the disclosure relates to a wellbore gun builder for assembling a wellbore gun. The wellbore gun builder comprises the chuck assembly as in claim 1; and a feed assembly comprising a conveyor positioned about the chuck assembly to selectively feed the wellbore gun through the passage.

In yet another aspect, the disclosure relates to a method of building a wellbore gun. The method comprises feeding gun components of the wellbore gun into a build assembly by: feeding a first gun, a gun sub, and a second gun into a chuck assembly with the gun sub positioned between the first gun and the second gun; gripping the first gun with an axial gun chuck of the chuck assembly; and gripping the second gun with a rotating gun chuck of the chuck assembly. The method further comprises: selectively connecting the gun components of the wellbore gun with the build assembly by: applying a torque to rotate the rotating gun chuck; and allowing the axial gun chuck to move axially about the rotating gun chuck.

In at least one aspect, the present disclosure relates to a wellsite tracker. The wellsite tracker comprises a tracker housing; a communication unit positioned in the tracker housing; and a location unit. The location unit is positioned in the tracker housing to collect location data. The location unit comprises a three-axis location sensor. The location data comprises spatial location and time.

In another aspect, the disclosure relates to a wellsite monitoring system. This system comprises the wellsite tracker and a wellsite monitor. The wellsite monitor is communicatively coupled to the communication unit to receive the location data therefrom. The wellsite monitor comprises a central processor to generate outputs based on the location data.

The disclosure also relates to a wellsite tracker, a wellsite monitoring system, and methods of monitoring wellsite operations as described herein.

The method of monitoring wellsite operations comprises positioning a wellsite tracker about a transporter; positioning the transporter about the wellsite; using the wellsite tracker, detecting location data; and generating outputs based on the location data. The outputs comprise an inferred location of well equipment.

In another aspect, the disclosure relates to a wellsite tracker for tracking wellsite equipment at a wellsite. The wellsite tracker comprises a tracker housing, a location antenna, a location unit, and a communication unit. The tracker housing is positionable on the wellsite equipment. The tracker housing has an antenna chamber and a component chamber. The component chamber is isolated from the antenna chamber by a barrier. The location antenna is positioned in the antenna chamber. The location antenna is coupled to a plurality of coordinate satellites to receive location data therefrom. The location data comprises three-axis coordinate data. The location unit is positioned in the component chamber and coupled to the location antenna to receive the location data therefrom. The location unit comprises a clock and a location processor to receive the location data over time and to infer tracking data based on the location data and the time. The tracking data comprises spatial location and the time of the wellsite equipment based on the location data. The tracker communicator comprises a communication unit and a communication antenna. The communication unit is positioned in the component chamber and coupled to the location unit to receive the tracking data therefrom. The communication antenna is positioned in the antenna chamber and coupled to the communication unit to receive the tracking data therefrom. The communication antenna extends through the tracker housing to transmit the tracking data about the wellsite.

In another aspect, the disclosure relates to a wellsite monitoring system for monitoring wellsite equipment at a wellsite. The wellsite monitoring system comprises the wellsite tracker; and a wellsite monitor. The wellsite monitor is coupled to the communication antenna of the wellsite tracker to receive the tracking data therefrom. The wellsite monitor comprises a monitor processor to generate outputs based on the location data.

Finally, in another aspect, the disclosure relates to a method of monitoring wellsite operations at a wellsite. The method comprises positioning a wellsite tracker about wellsite equipment at the wellsite, the wellsite equipment comprising a transporter; using the wellsite tracker, receiving location data from a plurality of satellites as the well site equipment moves about the wellsite; inferring tracking data for the wellsite equipment based on the location data over time, the tracking data comprising spatial location and the time of the wellsite equipment; and confirming wellsite operations by comparing the tracking data for the wellsite equipment with predetermined specifications.

This Summary is not intended to be limiting and should be read in light of the entire disclosure including text, claims and figures herein.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. The appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

Figure 1A:
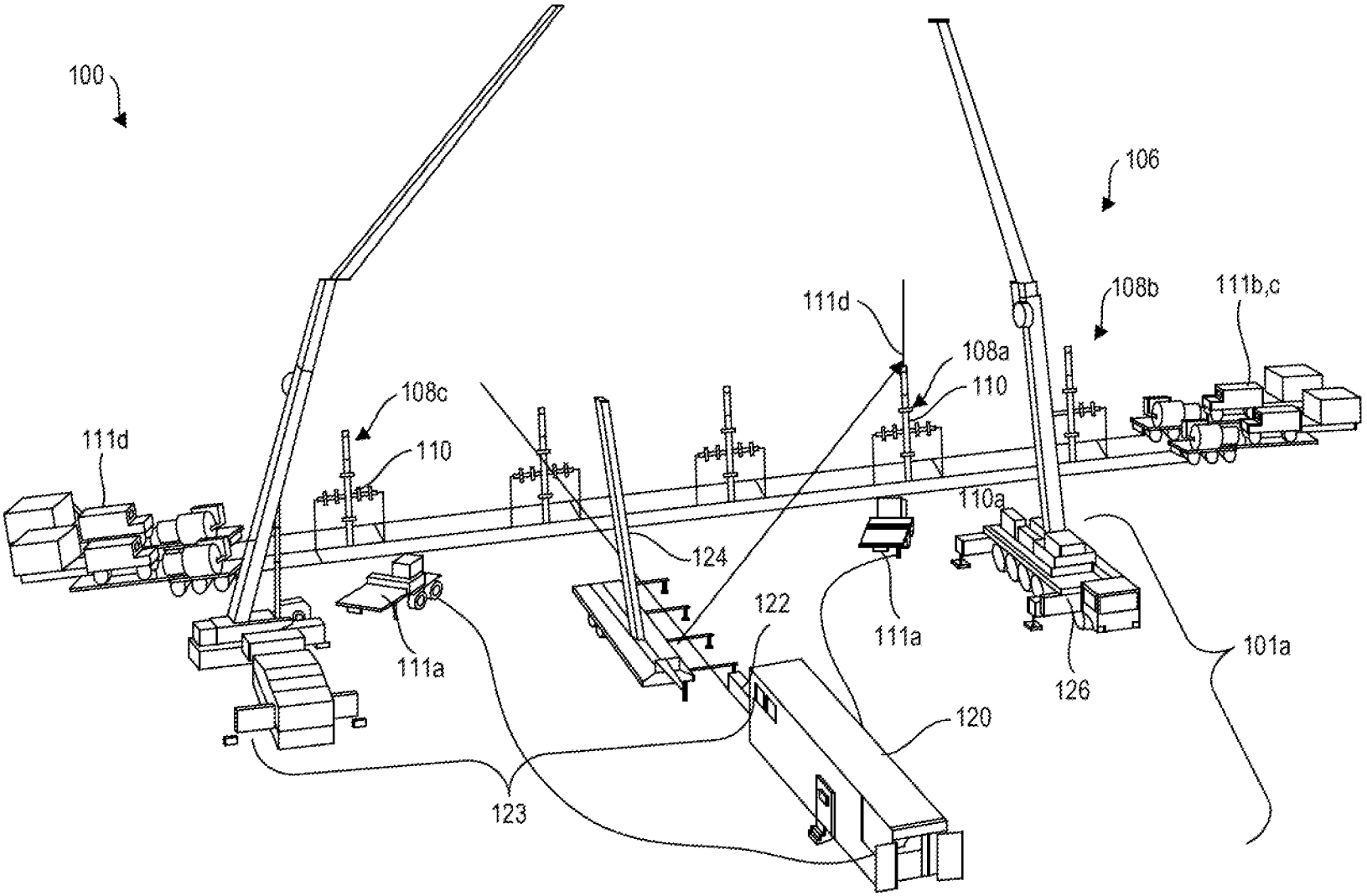
FIGS. 1A-1B are schematic diagrams depicting views of a wellsite with a tool processing system.

The description that follows includes exemplary apparatus, methods, techniques, and/or instruction sequences that embody techniques of the present subject matter. However, it is understood that the described embodiments may be practiced without these specific details.

Integrated Tool Processing System

This disclosure relates to a tool processing system for assembling and delivering a downhole (or other wellsite) tool, such as a perforating gun. The tool processing system includes multiple processing devices (stages): a tool assembler for assembling the downhole tool, a tool stager for staging the downhole tool, a tool lift for positioning the downhole tool, and a tool transporter for transporting the downhole tool. Each of these processing devices may be configured with their own individual structure for performing their separate individual functions. For example, the tool assembler may use a gun builder to automatically assemble (e.g., thread) portions of the downhole tool together, the stager may have the ability to store and select the assembled downhole tools, the tool lift may have the ability to facilitate transport of the selected downhole tools by positioning the downhole tool, and the tool transporter may have the ability to move the lifted downhole tool to a selected well. Part or all of these individual functions may be performed individually or in combination for selected optimization of the functions.

The processing devices may be integrated and/or connected for sequential use to provides a unitary system for processing the downhole tool for use at a wellsite for use. The tool processing system may integrate the multiple processing devices and their associated tool operations into a single and continuous assembly for cycling of multiple downhole tools. The individual processing devices may also be integrated (e.g., connected together), for example, by transfer devices, such as conveyors, to provide a unified structure linking the individual functions and facilitating flow between the individual stages. This flow may be used, for example, to provide speed, efficiency, and safety while interconnecting the individual functions for consistency and alignment. Individual, overlapping, and/or combined portions of the tool processing system may be pre-set to pre-defined specifications to provide optimization across multiple of the processing devices. The tool processing system may also provide a repeatable structure with full or semi-automation, a fixed location, and a pre-set footprint positionable on or offsite.

The tool processing system and methods described herein are also intended to provide one or more of the following, among others: quick assembly, precise assembly, efficient assembly, simplified operation, repeatable operation, automated or semi-automated processing, multiple linked assembly operations for processing downhole tools, integrated operation for efficient processing, quick cycling of downhole tools, on or offsite assembly and/or pre-assembly, enhanced equipment reliability, reduction in cost, flexibility of use, time savings, efficient operation, reduced maintenance costs, transportability, etc.

Figure 1B:
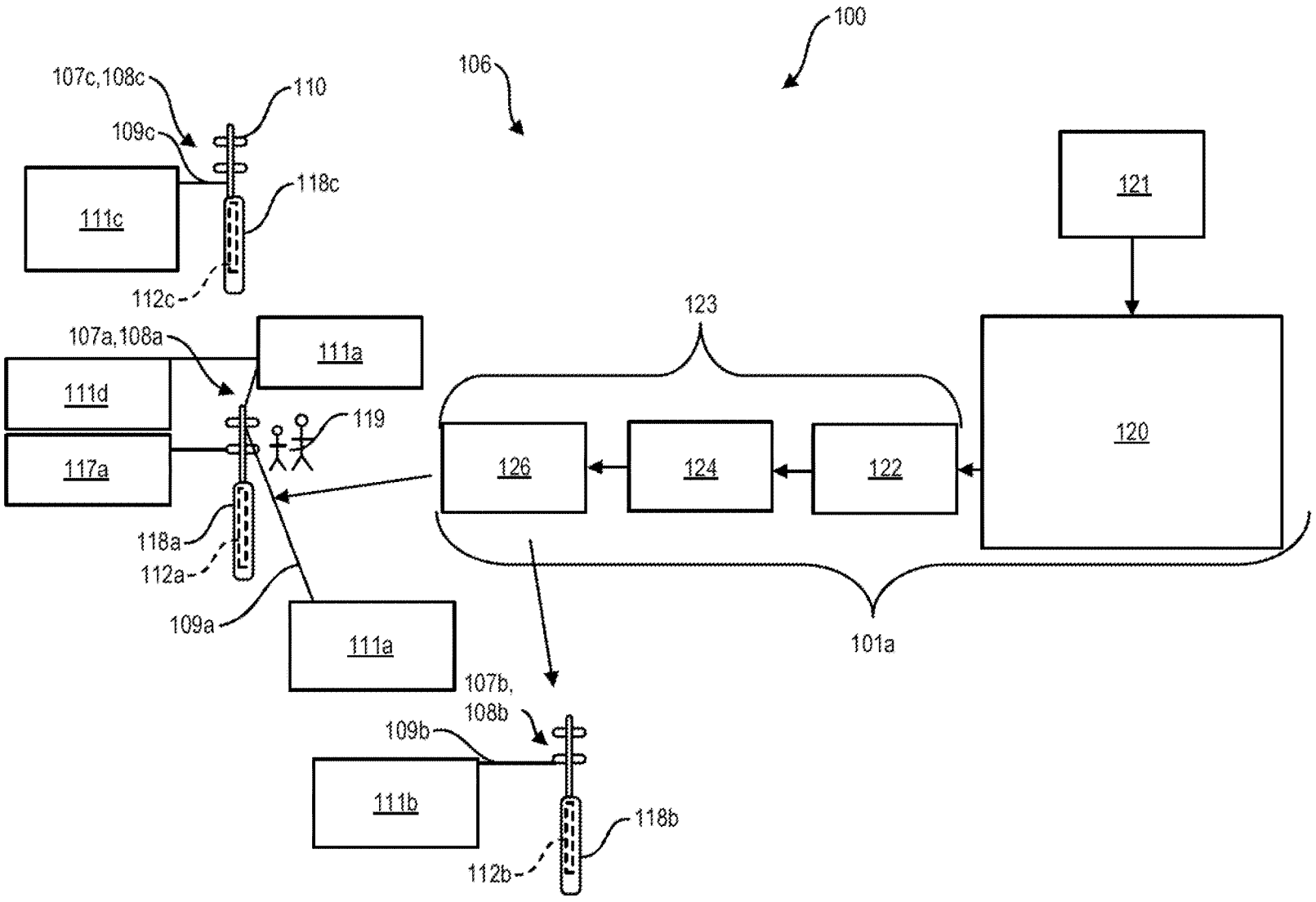

FIGS. 1A-1B are schematic diagrams depicting a wellsite 100 with a tool processing system 101*a*. These figures show an example wellsite 100 that may be used for processing (e.g., assembling, staging, storing, lifting, transferring, etc.) part or all of wellsite equipment, such as a downhole tool, for use at the wellsite 100. In this example, the wellsite 100 is a well pad with wells 108*a-c* thereon. The wellsite 100 may be provided with wellsite equipment 106 for processing and/or use at the wellsite 100.

The well equipment 107*a-c* may be used independently, or in combination, and with one or more wells 108*a-c*. The well equipment 107*a-c* at each of the wells 108*a-c* includes surface equipment 110 and downhole tool 112*a-c*. In the example shown, the surface equipment 110 at each of the wells 108*a-c* includes a production well head extending a distance above the surface. The well equipment 107*a-c* may also include other equipment, such as conveyance carriers (e.g., winch or tubing spools) 111*a* for supporting a conveyance 109*a-c*, injection equipment 111*b* for injecting fluid into the wellbore as shown at well 108*b*, fracking equipment 111*c* for fracturing subsurface formations as shown at well 108*c*, and a wireline truck 111*d* for performing downhole operations (e.g., perforating).

The surface equipment may also include a surface unit 117*a* for operating equipment at one or more of the wells 108*a-c*. The surface unit 117*a* may be standard control equipment for operating the wells 108*a-c*, such as hydraulic, electronic, and/or other controllers (e.g., central processing units (CPUs)). In the examples shown, the surface unit 117*a* is coupled to well 108*a* and the wireline truck 111*d* for performing a wireline operation. A crew 119 of one or more workers may also be provided for performing operations at the wells 108*a-c*.

The downhole tool 112*a-c* may include various downhole tools positionable in the wellbores 118*a-c* for performing downhole operations, such as a perforating tool 112*a* as shown at well 108*a*, an injection tool 112*b* as shown in well 108*b*, and a fracking tool 112*c* as shown at well 108*c*. The perforating tool 112*a* may be, for example, a perforating gun as described in US Patent Application No. 2020/0072029, previously incorporated by reference herein.

The wellsite equipment 106 also includes the tool processing system 101*a*. The tool processing system 101*a* includes a tool assembler 120 and a tool transfer 123. The tool processing system 101*a* may also include other components, such as component storage 121 for housing tool components used to form the downhole tools 112*a-c*. The tool assembler 120 may include various assembly tools for connecting tool components together to form the downhole tool 112*a-c* as is described further herein.

Once assembled, the downhole tool 112*a-c* is moved from the tool assembler 120 to the tool transfer 123. The downhole tool 112*a-c* may then be moved by the tool transfer 123 from the tool assembler 120 to a select well 108*a-c*. In the example shown, the tool transfer 123 includes tool stager 122 for storing the downhole tool 112*a-c*, a tool lift 124 for positioning the downhole tool 112*a-c*, and a tool transporter 126 for transporting the downhole tool 112*a-c* to the well 108*a-c* as is described further herein.

FIGS. 1A and 1B also show example wellsite operations at wells 108*a-c* that may be used with the wellsite equipment 106 at the wellsite 100. The first well 108*a* shows a perforating operation with the downhole tool 112*a* deployed into the wellbore 118*a* by the conveyance (wireline) 109*a* for forming perforations to facilitate production of subsurface fluids. The downhole tool 112*a* (and the conveyance 109*a*) may be raised and lowered about the wellbore 118*a-c* by the winch 111*a*. The second well 108*b* shows an injection operation with the downhole tool 112*b* positioned in the wellbore 118*b* for injecting fluid. The downhole injection tool 112*b* is coupled to the injection equipment 111*b* by the conveyance (tubing) 109*b*. The injection equipment 110*b* may be, for example, fluid tanks with pumps for pumping fluids for injection fluid into the surrounding formation. The downhole injection tool 112*c* is coupled to the fracking equipment 111*b* by the conveyance (flowlines) 109*c*. The third well 108*c* shows a fracking operation with the downhole tool 112*c* positioned in the wellbore 118*c* for fracking the formation. The fracking equipment 111*b* may be, for example, one or more blender, mixing, or other trucks with pumps for pumping fracking fluids into the surrounding formation.

Figure 2:
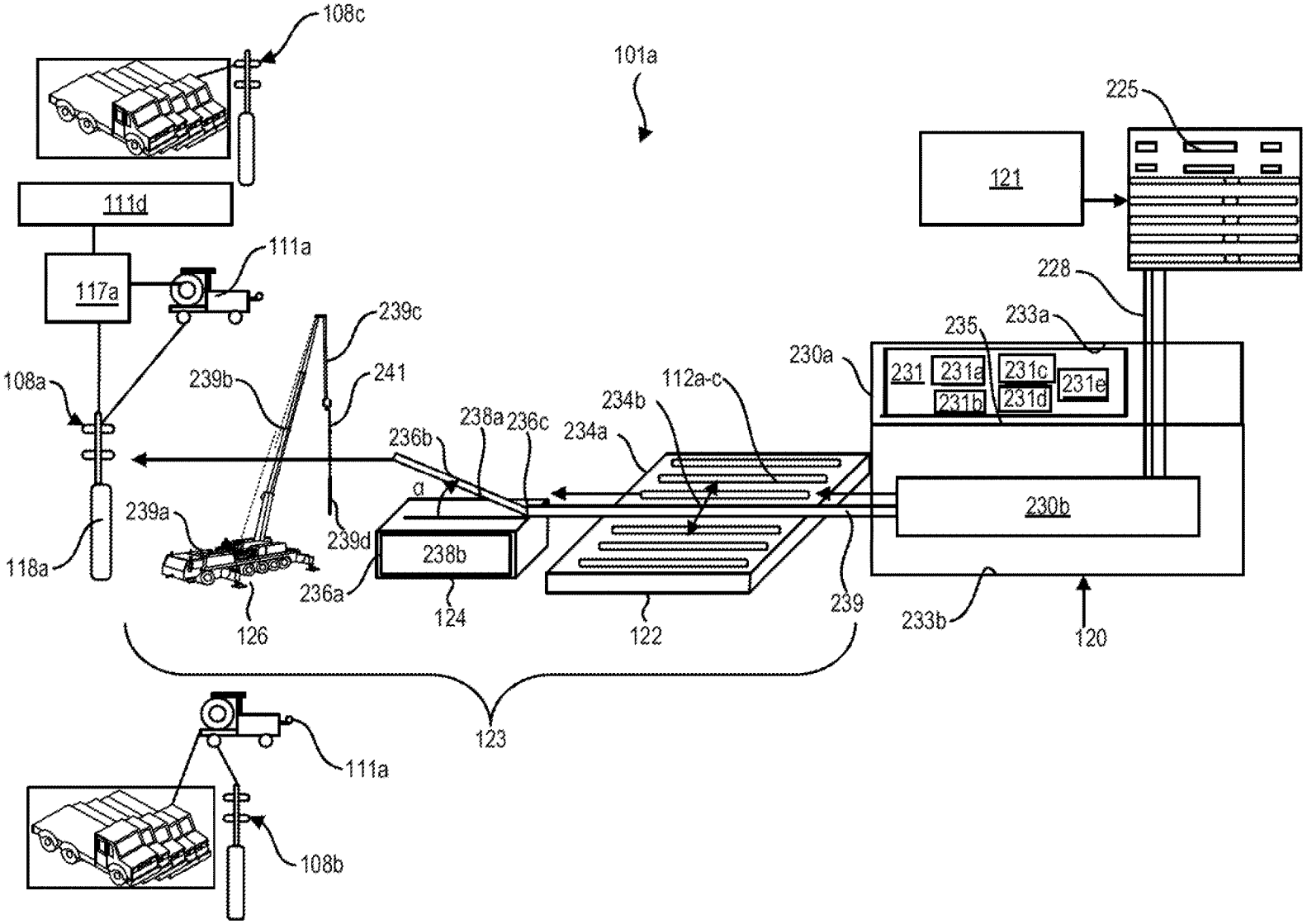
FIG. 2 is a schematic diagram depicting another view of the wellsite and the tool processing system.
Figure 3A:
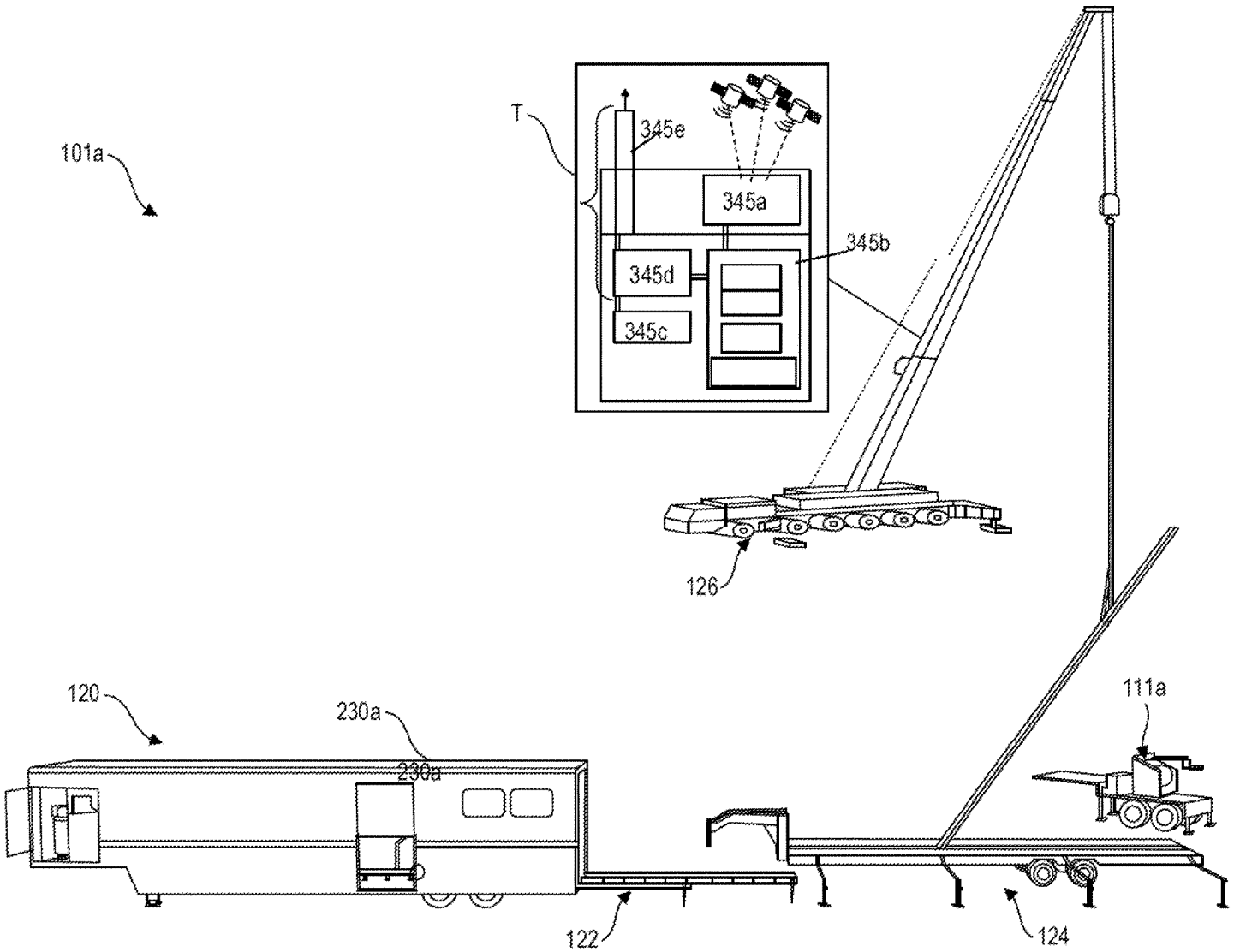
FIGS. 3A and 3B are schematic diagrams depicting the tool processing system.
Figure 3B:
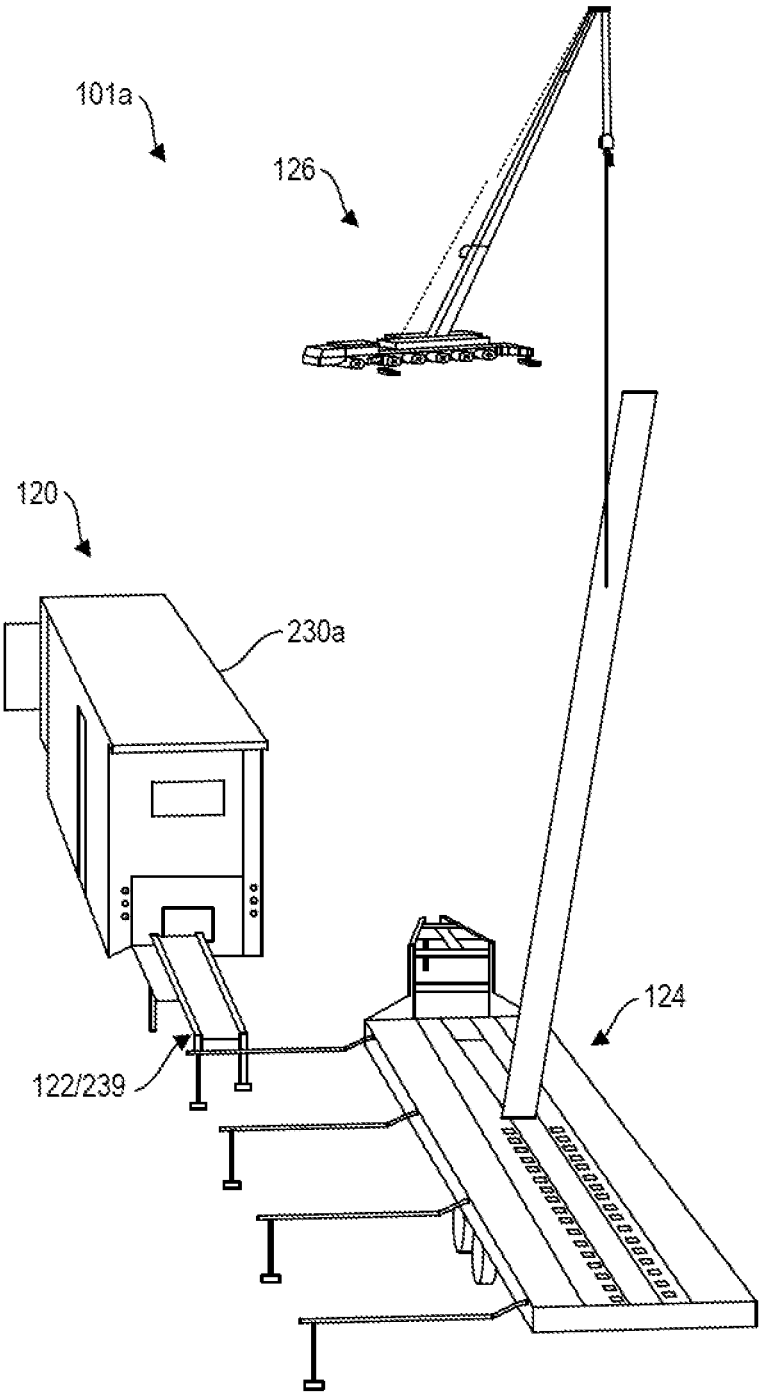

FIG. 2 is a schematic diagram depicting the tool processing system 101*a* in an integrated configuration. FIGS. 3A-5B show the components of the tool processing system 101*a* in greater detail. FIGS. 3A-3B are schematic diagrams depicting the tool processing system. FIGS. 4A-4D are schematic diagrams depicting a tool assembler. FIGS. 5A and 5B are schematic diagrams depicting a tool lift.

As shown in FIGS. 2, 3A, and 3B, the tool processing system 101*a* includes multiple processing components, connected together to form a unified assembly. The processing components include the tool assembler 120, and the tool transfer 123 integrated together into a combined system. This integrated configuration of the tool processing system 101*a* may be used to process any of the downhole tools 112*a-c* (or other wellsite equipment 106) from start to finish. The integrated tool processing system 101*a* may be positioned onsite for performing multiple stages of a processing operation for providing the downhole tools 112*a-c* for use at any of the wells 108*a-c*.

As shown in FIG. 2, the processing components may also include the component storage 121. The component storage 121 may be any container, such as a shelf, shed, box, etc. for storing one or more of the tool components 225 and/or other wellsite equipment 106 (FIGS. 1A and 1B). The tool components 225 may include, for example, subs, housing, electronics, and other portions of one or more of the downhole tools 112*a-c*. The tool components 225 may be, for example, portions of the downhole perforating tool 112*a* for performing perforations in the wellbore 118*a* at well 108*a* (FIGS. 1A and 1B).

The component storage 121 may be coupled to the tool assembler 120 by a tool feeder 228 for delivering the tool components 225 to the tool assembler 120. The tool feeder 228 may be any device capable of moving the components to the tool assembler 120 for assembly. The tool feeder 228 may be, for example, a crane, conveyor, loader, or other feeding device for lifting, positioning, lowering, and/or transferring the tool components 225 to the tool assembler 120. The tool feeder 228 may be operatively connected to and/or integrated with the tool assembler 120 to work therewith. For example, the tool feeder 228 may be a conveyor connected from the component storage 121 to portions of the tool assembler 120, such as another conveyor of the tool assembler 120, to feed the tool components 225 directly into the tool assembler 120. The tool feeder 228 may also have capabilities for scanning and monitoring the tool components and/or for performing storage and/or feed operations as is described further herein.

As shown in FIGS. 2, 3A—3B, and 4A-4D, the tool assembler 120 may include an assembly facility 230*a* and assembly equipment 230*b*. The assembly facility 230*a* may be any structure capable of housing the assembly equipment 230*b* during assembly operations. The assembly facility 230*a* may be a mobile structure, such as a trailer capable of housing and transporting the assembly equipment 230*b* to various locations before, during, and/or after assembly. Examples of an assembly facility and assembly equipment that may be used are described in U.S. Patent Application No. 63/135,910 and PCT Patent Application No. PCT/US22/11739, previously incorporated by reference herein.

The assembly facility 230*a* may also have separate rooms, such as an assembly room 233*a* for housing the assembly equipment 230*b* and an operations room 233*b* for housing operation components. The operations room 233*b* may be isolated from the operations room by a barrier 235 to prevent electrical signals from creating noise therebetween. The operation components may be, for example, an operator station 231 including operation equipment (e.g., input/output (I/O) devices 231*a*, power supplies 231*b*, monitors 231*c*, processors 231*d*, memory/databases 231*e*, etc.) for use with the tool processing system 101*a*, the tool assembly 120, and/or other portions of the wellsite 100 as is described further herein.

The assembly room 233*a* may operatively support the assembly equipment 230*b* therein. The assembly room 233*a* may have doors to allow connection to the feeder 228 of the storage 121 and/or the tool stager 122. Storage and other equipment may also be provided in the assembly room 233*a* as needed for use with the assembly equipment. The assembly equipment 230*b* may include various assembly equipment and/or tools for connecting tool components together to form the downhole tools 112*a-c*. The assembly equipment 230*b* may include, for example, a workstation with hand tools operated by an operator (not shown) to connect the tool components 225 together.

Figure 4A:
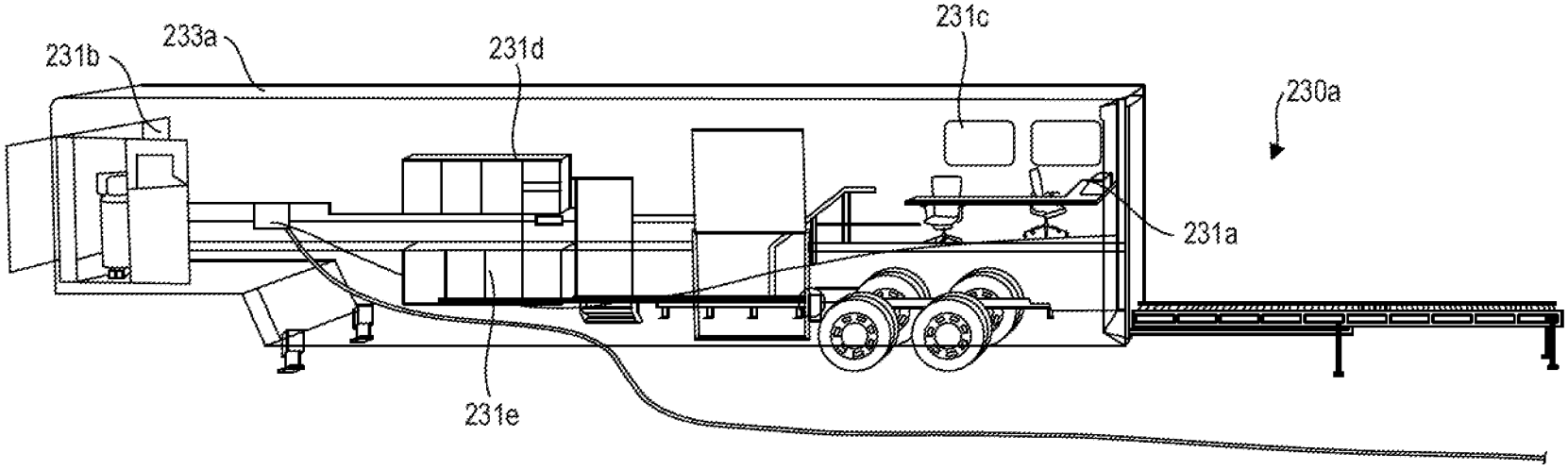
FIGS. 4A-4D are schematic diagrams depicting various views of a tool assembler.
Figure 4B:
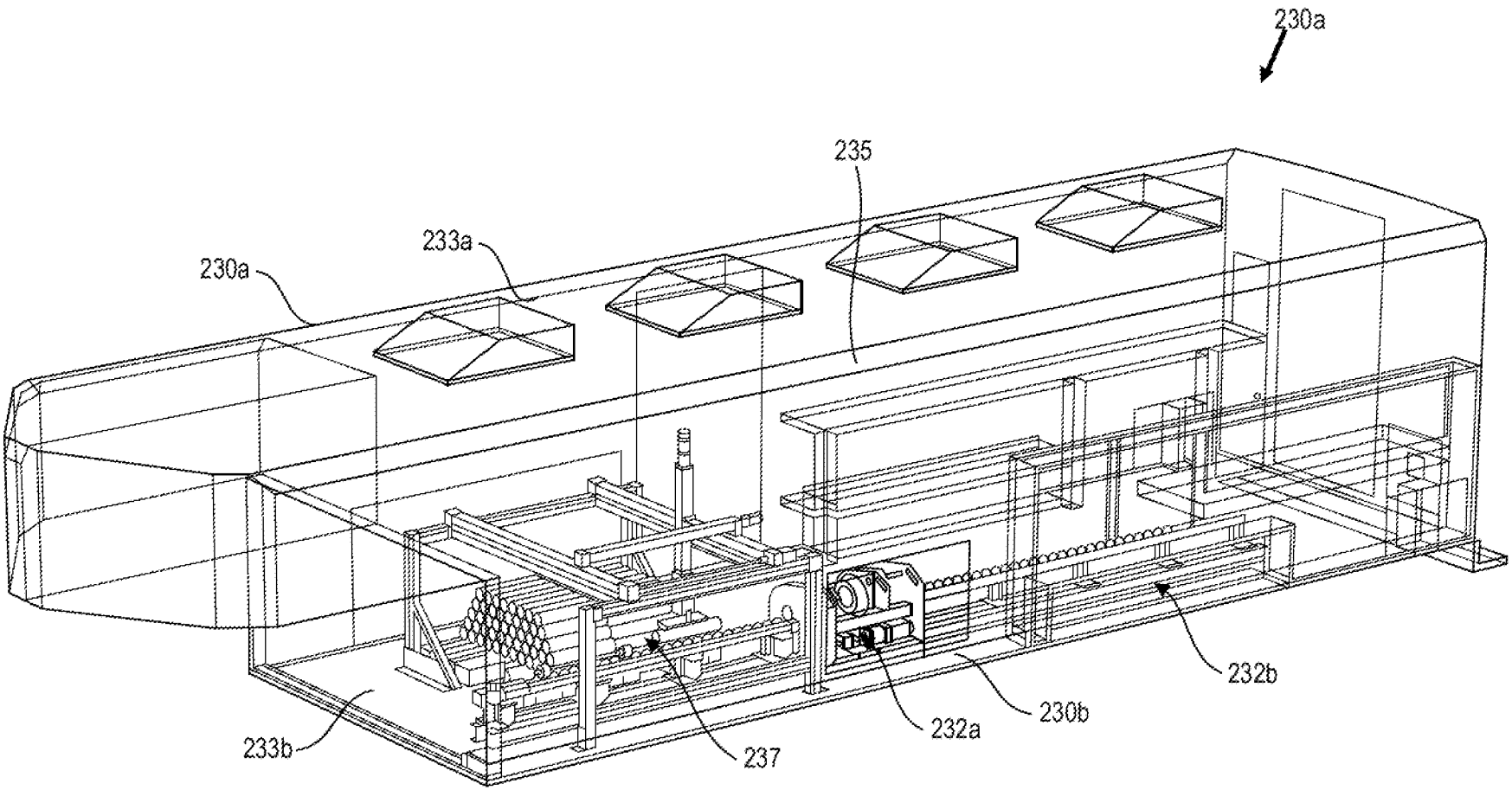
Figure 4C:
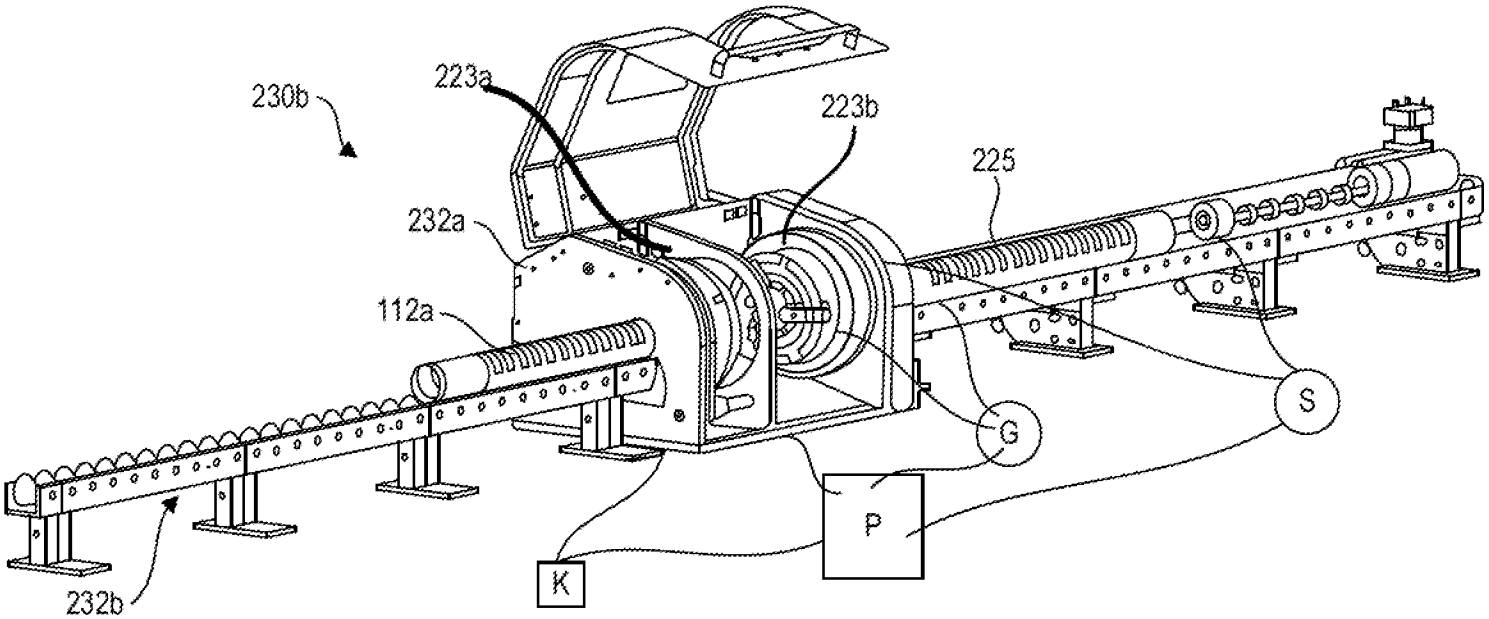
Figure 5A:
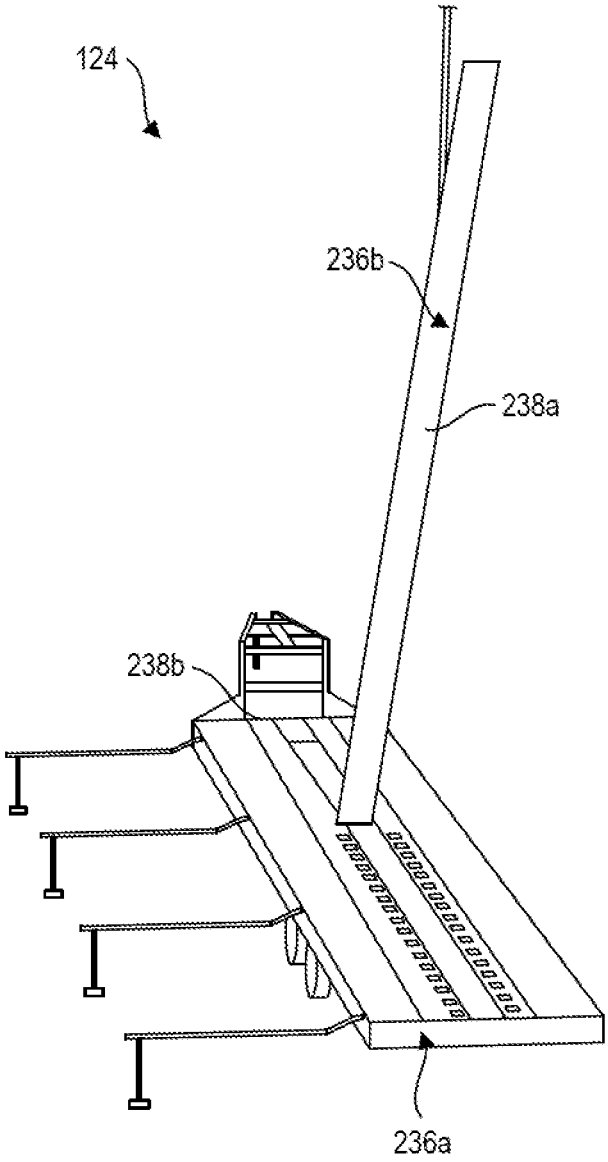
FIGS. 5A and 5B are schematic diagrams depicting a tool lift.
Figure 5B:
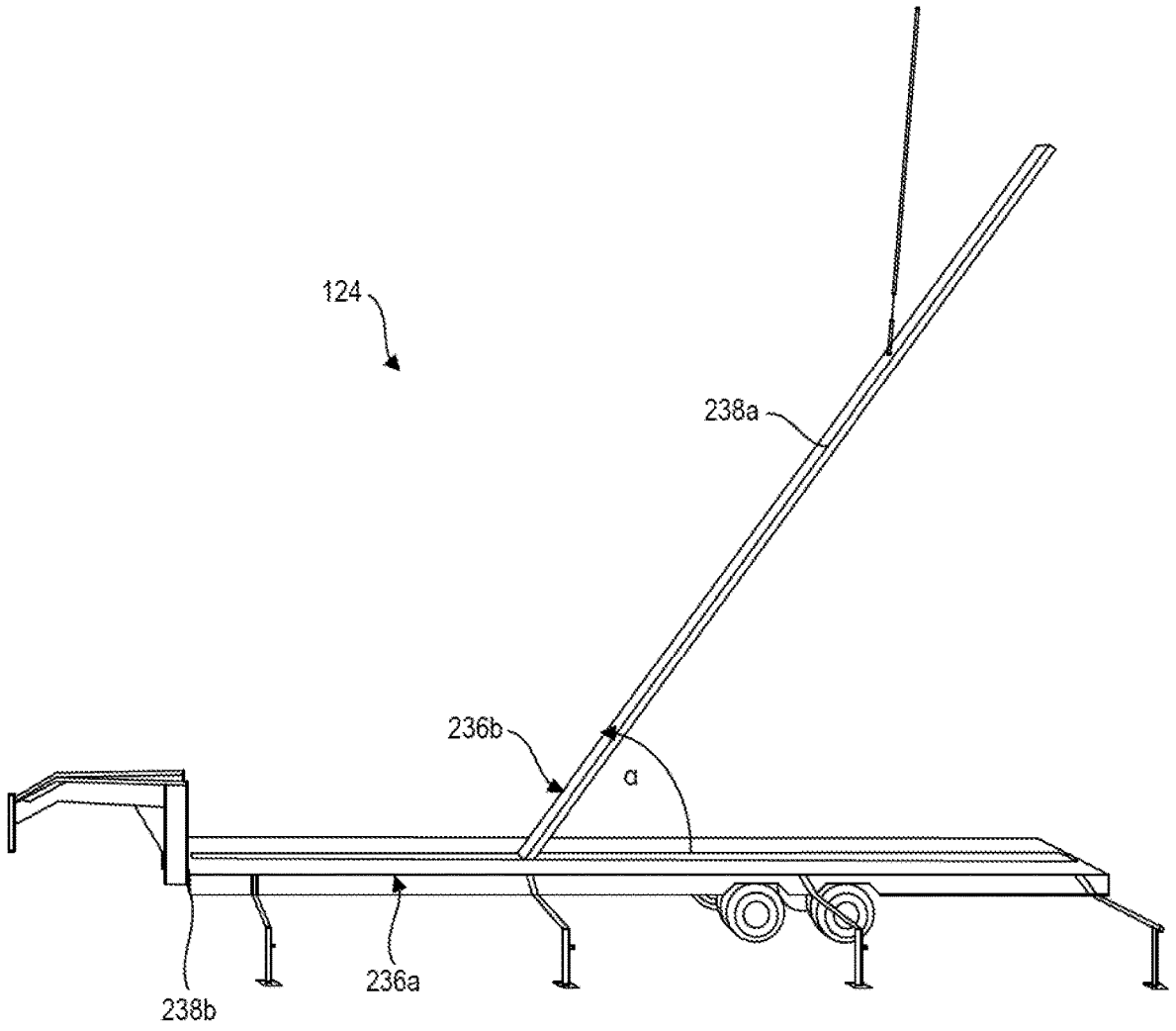

FIGS. 4B and 4C show an example version of the assembly equipment 230*b* in the form of a gun builder for threadedly connecting tool components, such as gun subs, together to form the perforating tool 112*a*. FIG. 4B shows the assembly equipment 230*b* positioned in the operations room 233*b*. FIG. 4C shows the assembly equipment 230*b* in greater detail. The assembly equipment 230*b* (gun builder) may include a build assembly 232*a* and a build conveyor 232*b* for putting the tool components 225 together to form the perforating tool 112*a*. The build conveyor 232*b* may selectively advance the tool components 225 into the build assembly 232*a* where the adjacent tool components 225 are selectively rotated and threadedly joined together. In this example, the build assembly 232*a* includes an axial chuck 223*a* for gripping a first downhole component 225 and a rotational chuck 223*b* for rotating a second downhole component 225 adjacent to the first downhole component 225 such that the first and second downhole components 225 are threaded together. The downhole components 225 and the downhole tool 112*a* are advanced through the chucks 223*a,b* by the build conveyor 232*b*.

Figure 4D:
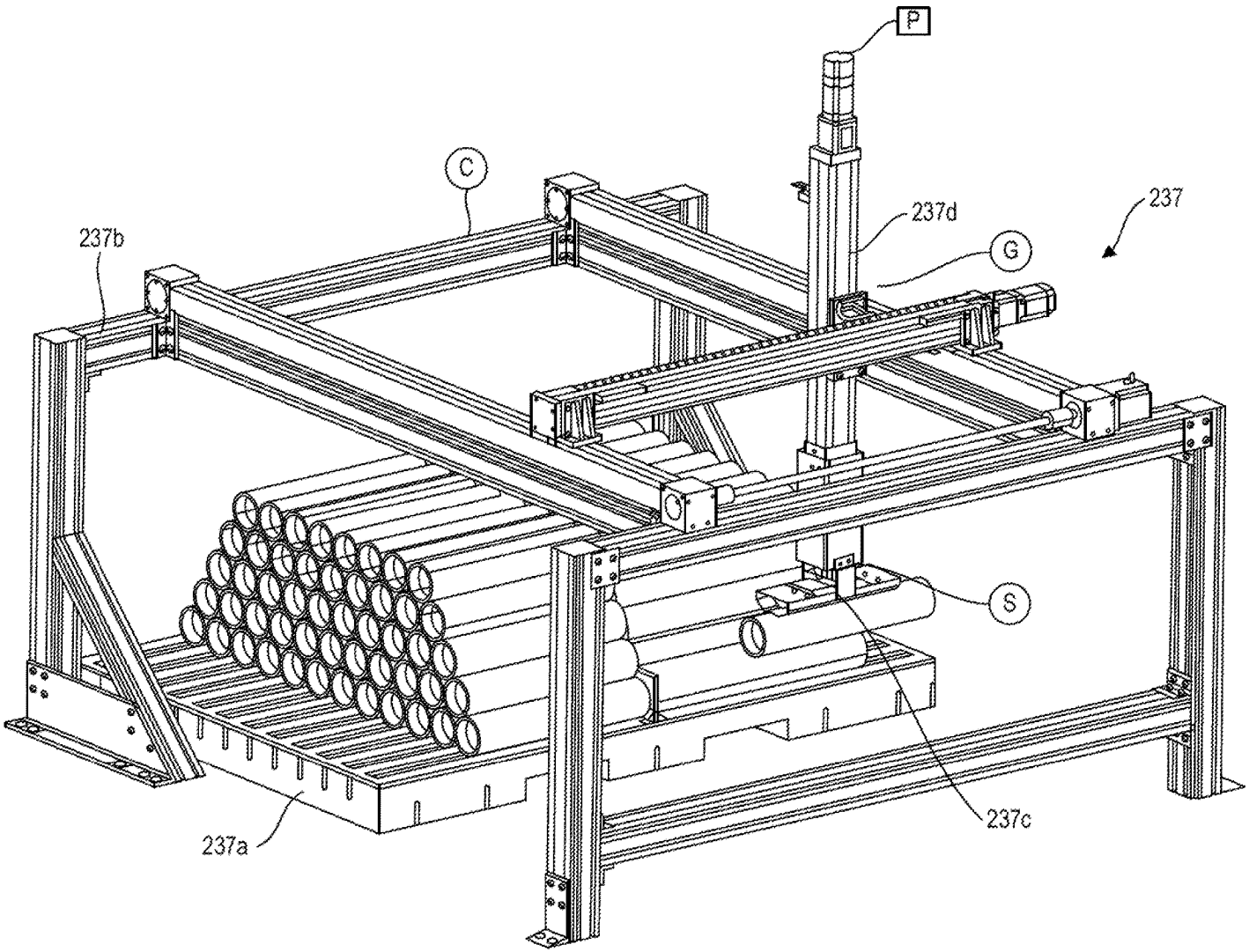

As shown in FIGS. 4B and 4D, the assembly equipment 230*b* may also include devices for integrating the tool assembler 120 and/or the assembly equipment 230*b* with other portions of the tool processing system 101*a*. For example, a loader 237 may be connected to or integral with the tool feeder 228 for receiving the tool components 225 from the storage 121, and for passing the tool components 225 to the assembly equipment 230*b* for assembly. In the example shown, the loader 237 is a gantry loader including a platform 237*a* for storing tool components, a gantry frame 237*b* for supporting the tool components 225, a gantry gripper 237*c* for gripping the tool components 225, and a gantry driver 237*d* for moving the tool components 225 along the gantry frame and to the conveyor 232*b* for positioning onto the assembly equipment 230*b* for assembly.

As shown in FIGS. 4C and 4D, the assembly equipment 230*b* and/or the loader 237 may be provided with electronics for operation. These electronics may be used for monitoring, controlling, operating, etc. For example, the electronics may provide for automated, semi-automated, operation by operators, etc. Such electronics may include, for example, sensors S for detecting the tool components 225, gauges G sensing operating parameters of the assembly equipment, camera C for detecting location/identification, processor P processing data from the assembly equipment 230*b*, switch K for controlling operation of the assembly equipment 230*b*, and/or other equipment. Further details of the gun builder are described in U.S. Patent Application No. 63/135,910 and PCT Patent Application No. PCT/US22/11739, previously incorporated by reference herein.

Referring back to FIG. 2, in another example, a staging conveyor 239 may be connected to or integral with the build conveyor 232*b* for receiving the assembled downhole tool 112*a* therefrom. The staging conveyor 239 may also be connected to the stager 122 for passing the downhole tool 112*a* assembled by the tool assembler 120 to the tool stager 122. The staging conveyor 239 may include drives (not shown) for moving (e.g., receiving, pulling, drawing, and/or positioning) the perforating tool 112*a* from the staging conveyor 239 and to the tool stager 122.

As shown in FIGS. 2, and 3A—3B, the tool stager 122 may include the conveyor 239 for receiving and/or transferring the downhole tool 112*a* to the lift 124. The conveyor 239 as shown may be a conventional roller conveyor for moving the downhole tool 112*a* between the tool assembler 120 and the tool lift 124. Optionally, the tool stager 122 may also be provided with features to facilitate storage, sorting, inventorying, and/or otherwise manipulating the downhole tool(s) received from the assembly equipment 230*b*. For example, the tool stager 122 may be provided with a storage container 234*a* for holding one or more of the downhole tools 112*a*, and a sorter 234*b* selecting the downhole tools 112*a* for movement to the storage container 234*a* and/or the tool lift 124. Other devices for monitoring/scanning, detecting, etc. may also be provided.

The storage container 234*a* may be any container capable of receiving and storing the downhole tools 112*a-c* and/or other wellsite equipment 106. When needed, the stored downhole tools 112*a-c* may be passed by the sorter 234*b* from the storage container 234*a* to the storage container 234*a* and/or to the tool lift 124. The sorter 234*b* may be, for example, one or more conveyors capable of passing the downhole tools 112*a-c* from the tool assembler 120 to the storage container 234*a*, from the storage container 234*a* to the tool lift 124, and/or from the tool stager 122 directly to the tool lift 124 or other location. In at least some cases, the downhole tools 112*a-c* may be stored on the sorter 234*b* with or without passing to the storage container 234*a*. The sorter 234*b* may be coupled to the staging conveyor 239 at one end for receiving the assembled downhole tools 112*a-c* and to the tool lift 124 at another end for passing the selected downhole tools 112*a-c* to the tool lift 124. The sorter 234*b* may include additional portions for selectively diverting the downhole tools 112*a-c* about the storage container 234*a*, the tool lift 124, and/or other locations as desired. The tool stager 122 may also have capabilities for scanning, monitoring, and storing the downhole tools 112*a-c* and/or for performing staging operations, such as storage and sorting, as is described further herein.

As shown in FIGS. 2, 3A-3B, and 5A—5B, the tool lift 124 may include a lift base 236*a* and a lifter 236*b*. The lift base 236*a* may be a structure supported on the ground for housing and/or supporting the lifter 236*b*. The lifter 236*b* includes a lift arm 238*a* and a lift driver 238*b*. The lift arm 238*a* may be an elongate member movably (e.g., slidably and pivotally) connected to the lift base 236*a* and extendable therefrom. The lift arm 238*a* may be connectable to the tool stager 122 for receiving the downhole tools 112*a* therefrom. The lifter 236*b* may be connected directly to the tool stager 122 and/or the sorter 234*b*, or connected indirectly by a lift conveyor 236*c* to the tool stager 122 and/or the sorter 234*b*. The lift conveyor 236*c* may be connected at one end to the sorter 234*b* and at another end to the lift arm 238*a* for passing the downhole tools 112*a-c* from the tool stager 122 to the lift arm 238*a*. The lifter 236*b* may optionally have rollers, a conveyor, and/or other devices (not shown) thereon for facilitating receipt of the downhole tool 112*a-c* thereon.

The lift arm 238*a* may be movably positioned about the lift base 236*a* by the lift driver 238*b*. The lift driver 238*b* may be, for example, a motor positioned in the lift base 236*a* for selectively positioning (e.g., raising, sliding, tilting, orienting, etc.) the lift arm 238*a* about the lift base 236*a* and/or for operating the lifter 236*b*. The lift arm 238*a* is capable of receiving and supporting the downhole tool 112*a* during this positioning. For, example, the lifter 236*b* may have an end pivotally connected to the lift base 236*a* and another end raised at an angle $\alpha$ to a distance above the lift base 236*b*. The angle $\alpha$ and distance may be selected to position the downhole tool 112*a* for receipt and transport by to the tool transporter 126 (e.g., an angle $\alpha$ of from about 30 degrees to about 60 degrees). The tool lifter 124 may also have capabilities for monitoring and positioning the downhole tools 112*a-c* and/or for performing the lift operations as is described further herein.

As shown in FIGS. 2, and 3A-3B, the tool transporter 126 may be any device capable of automatic, semi-automatic, or manual operation to transfer the downhole tools 112*a-c* from the tool lift 124 to an assigned well 108*a-c*, such as a crane, conveyor, truck, or other mechanism. The tool transporter 126 may also be capable of moving any wellsite equipment 106 about any locations at the wellsite 100, such as from the tool assembly 120 directly to the wells 108*a-c*. The tool transporter 126 may be positioned at any location within reach of the equipment to be transported.

In the example shown in FIGS. 3A and 3B, the tool transporter 126 is a crane positioned about the tool lift 124 for receiving the downhole tools 112*a-c* from the lift arm 238*a*. The tool transporter 126 may include, for example, a vehicle 239*a* for moving the tool transporter 126 into position to the select location, a boom 239*b* carried by the vehicle 239*a*, a hoist 239*c* for lifting/lowering the downhole tool 112*a* about the boom 239*b*, and a gripper 239*d* for securing the downhole tool 112*b* to the hoist 239*c*. The tool transporter 126 may use the gripper 239*d* to secure the downhole tool 112*a-c*, the hoist 239*c* to raise and lower the downhole tool 112*a-c*, a lubricator 241 to receive the downhole tool 112*a-c*, and the boom 239*b* and/or the vehicle 239*a* to move the downhole tool into position for connection at the well 108*a*. Examples of tool transporters that can be used are described in PCT Application No. PCT/US22/11740, previously incorporated by reference herein.

The transporter 126 may also be used to facilitate use of the downhole tools 112*a-c* at the wells 108*a-c*. For example, the transporter 126 may carry the downhole tools 112*a-c* from the tool lift 124 and to the wells 108*a-c* in a structure, such as the lubricator (protective tubing) 241. For example, the downhole tool 112*a* may be inserted into the lubricator 241 and the transporter 126 may transport the lubricator 241 with the downhole tool 112*a* therein to the well 108. At the well 108*a*, the transporter 126 may positions the downhole tool 112*a* above the surface equipment 111*a-d* for connection of the lubricator 241 to the surface equipment 111. The downhole tool 112*a* may be attached to the conveyance 109*a* and lowered with the conveyance carrier (e.g., winch) 111*a* through the lubricator 241 and into the well 108*a*. The lubricator 241 may be detached from the surface equipment 111*a-d* and carried away by the transporter 126.

The tool transporter 126 may also be provided with devices for monitoring a position of the tool transporter 126 and/or downhole tools 112*a-c*. As also schematically shown in FIG. 3A, the tool transporter 126 may be provided with a wellsite sensor, such as a wellsite tracker (locator) T. This tracker T may be secured to the tool transporter 126 to monitor location and other operational parameters. The wellsite tracker T may have global positioning satellite (GPS) location capabilities for detecting a location of the transporter over time. In an example, the wellsite tracker T may include a GPS antenna 345*a* coupled to satellites for receiving GPS data, a location unit 345*b* (including memory, clock, gauge, and processor) for processing the GPS data, a power supply 345*c*, a communication unit 345*d* for communicating the GPS data to other monitoring devices, and a communication antenna 345*e* for sending/receiving the communication data. Examples of wellsite trackers that can be used are described in PCT Application No. PCT/US22/11740, previously incorporated by reference herein.

FIG. 2 also shows the conveyance carriers 111*a* in use with the wells 108*a,b*, respectively. One or more conveyance carriers 111*a* may be stationary or movably positioned about the wellsite 100. Each of the conveyance carriers 111*a* may be provided with a rotary spool for supporting the conveyance 109*a*. In an example, the conveyance (e.g., wireline) 109*a* may deployed from the conveyance carriers 111*a* and connected to the downhole tool 112*a* for movably supporting the downhole tool 112*a* in the well 108*a* and/or for providing a surface connection with the conveyance carriers 111*a* and/or other wellsite equipment 106. The conveyance carrier 111*a* may be coupled to the wireline truck 111*d* and/or the surface unit 117*a* for operation therewith. In another example, the conveyance (e.g., tubing) 109*b* may be deployed from a spool and connected to the injection equipment 110*b* for use therewith. The conveyance 109*b* may be communicatively coupled between the downhole tool 112*a* and the wellsite equipment 106, such as the surface unit 117*a*, the injection equipment 110*b*, the fracking equipment 111*c*, the wireline truck 111*d*, etc. The conveyance carriers 111*a* and/or the wellsite equipment 106 may also have capabilities, and/or be coupled to devices for monitoring and positioning the wellsite equipment 106 and/or for performing the wellsite operations as is described further herein.

As shown in FIGS. 3A-3B, the tool processing system 101*a* may include various configurations of one or more of the processing components. In the example shown in these figures, the tool processing system includes the component storage 121, the tool assembler 120, and the tool transfer 123. The tool stager 122 is integrated with the tool assembler 120 to receive the downhole tools therefrom, and the tool stager 122 is not integrated with the tool lift 124. The tool transporter 126 or other means may be used to move the downhole tools 112*a-c* between the various components. As demonstrated by this example, one or more portions of the tool processing system 101*a* may be separate, integrated, or eliminated. While not shown, a component storage 121 and connections between each of the processing components may optionally be provided.

While FIGS. 1A-5B show example configurations of the wellsite 100, the wellsite equipment 106, the well equipment 107*a-c*, the tool processing system 101*a*, and/or other devices positioned about wells 108*a-c* of a specific wellsite 100, such configurations may vary. For example, each well 108*a-c* may use one or more types of the well equipment 107*a-c* over time for performing various well operations, and one or more portions of the wellsite equipment 106 may be provided to support one or more wellsite operations. The various equipment described herein may be automatic, semi-automatic, and/or manually operated. The various equipment described herein may also be provided with monitoring and/or control capabilities as described further herein. In some versions, part or all of the tool processing system 101*a* may be formed into an integrated system positionable at the wellsite 100, or positioned offsite. One or more of the features described herein may be combined in various arrangements, with zero or more features excluded.

Figure 6:
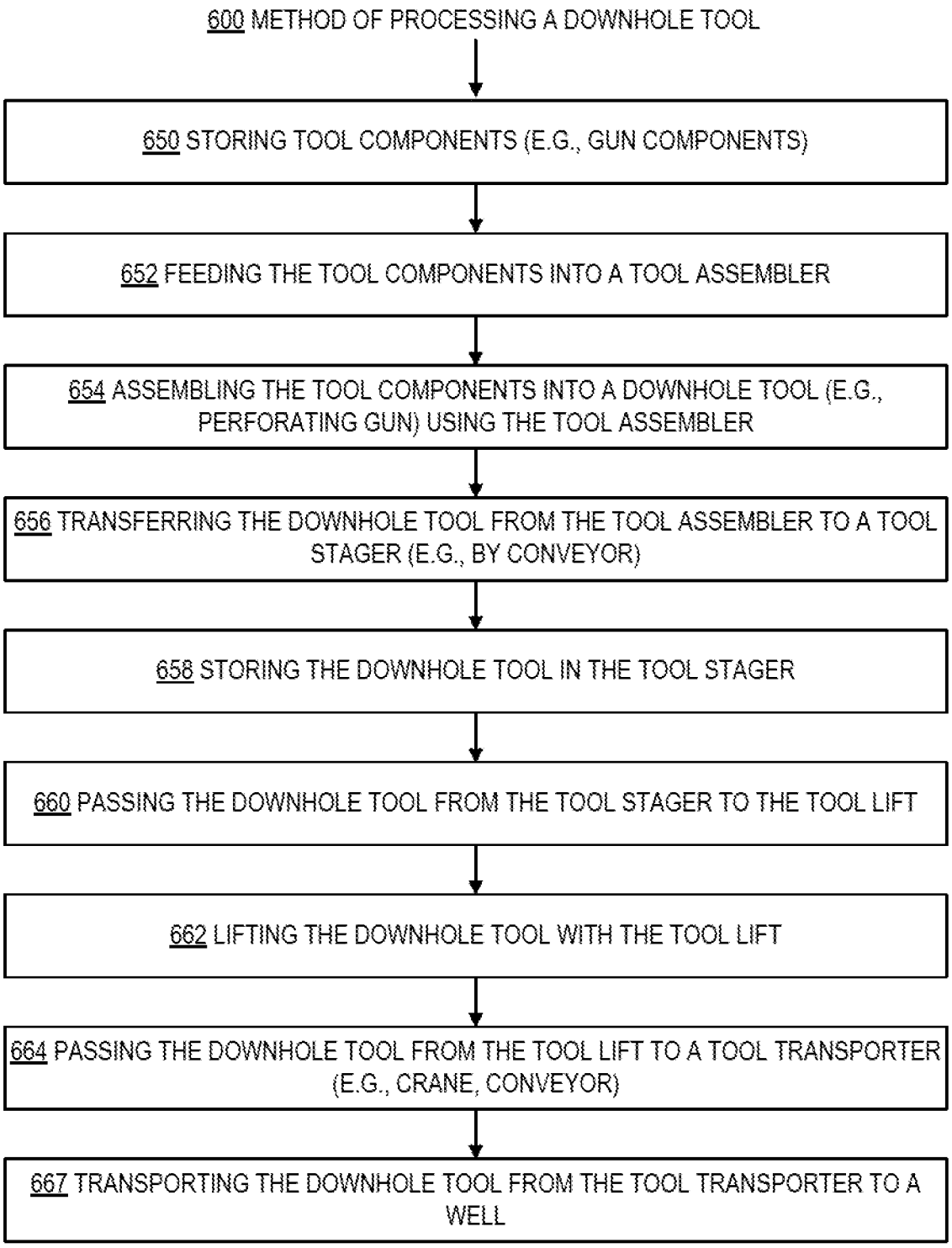
FIG. 6 is a flow chart depicting a method of processing a downhole tool.

FIG. 6 is a flow chart depicting a method 600 of processing a downhole tool. The method involves (650) storing tool components, (652) feeding the tool components into a tool assembler, (654) assembling the tool components into a downhole tool using the tool assembler, (656) transferring the downhole tool from the tool assembler to a tool stager, (658) storing the downhole tool in the tool stager, (660) passing the downhole tool from the tool stager to the tool lift, (662) lifting the downhole tool with the tool lift, (664) passing the downhole tool from the tool lift to a tool transporter, and (667) transporting the downhole tool from the tool transporter to a well.

Part or all of the method 600*a* may be performed at any time. Portions of the method 600 may be optional. Part or all of the method 600 may be repeated. Part or all of the method 600 may be performed using separate, integrated, manual, semi-automatic, and/or automatic techniques.

Well Site Monitoring

The present disclosure also relates to a wellsite monitoring system usable with the tool processing system. The wellsite monitoring system includes wellsite sensors (and/or trackers), wellsite monitors, and a central station coupled (by wire or wirelessly) about the wellsite for providing communication, information capture, and cooperation between one or more portions of the wellsite. The wellsite sensors may be positioned about the wellsite to capture and process various wellsite data, such as tool, equipment, well, processing, and other data. The wellsite sensor(s) may include, for example, a wellsite tracker located about wellsite equipment. The wellsite tracker may include a location unit (e.g., a global positioning sensor (GPS) and processor), a communication unit (e.g., a transceiver), a location memory (e.g., database), and a power source (e.g., a battery) housed in a tracker housing. The wellsite tracker may be used to track a spatial location of the transporter (and/or the well equipment carried by the transporter) versus time as the transporter moves about a well. The wellsite sensor(s) may also include, for example, a process sensor (e.g., an assembly sensors) coupled to portions of the tool processing system (e.g., the tool assembler) for detecting and measuring processing operations (e.g., location, position, identification, assembly, torque, etc.).

The wellsite monitor may be coupled (by wire or wirelessly) to the wellsite sensors to capture and process tracker (and/or other) data captured by the wellsite sensors. The wellsite monitor may be used, for example, to collect data from the wellsite tracker and to monitor the location versus time of the transporter (and/or the well equipment carried by the transporter). The wellsite monitor may also be coupled to various sensors and/or monitors located about the wellsite, and/or at offsite locations. The wellsite monitor may also be used to collect data from the process sensors to detect processing, and make adjustments as needed.

The central station may capture and process (e.g., collect, communicate, analyze, generate, and/or otherwise act upon) the data received from one or more of the sensors and/or one or more of the monitors. The central station may be a centralized facility housed with portions of the tool processing system for receiving and integrating the data from the wellsite sensors and the wellsite monitors. This integrated data may be used to combine information from multiple sources about the wellsite for use in operating the tool processing system and other portions of the wellsite from a central location.

The wellsite monitor and/or the central station may combine and/or analyze sensor data and/or analyzed outputs gathered from the wellsite sensors and other well devices (e.g., downhole, surface, offsite, and/or other sensors, databases, and/or monitors). The wellsite monitor and/or the central station may then generate outputs (e.g., displays, reports, alarms, etc.) based on the collected and/or processed data. The wellsite monitor and/or the central station may also be used for confirming operating conditions about the wellsite (e.g., the proper equipment is at the proper well, operations are performed timely, specifications are met etc.), for generating outputs (e.g., displays, reports, alarms, etc.) based on the collected and/or processed data, and/or for operating the tool processing system and/or other portions of the wellsite.

The wellsite monitoring system and/or methods described herein are also intended to provide one or more of the following, among others: collecting data from various portions of the wellsite, collecting processed information from various portions of the wellsite, combining the data and the information from various portions of the wellsite, generating integrated analysis based on data and processed information from multiple sources, confirming wellsite operations meet specification, providing alarms for improper equipment and/or out of specification conditions, identifying equipment placement at various times, considering sensor and monitor data across multiple portions of the wellsite, determining location of well equipment versus time, confirming proper equipment is provided to a correct location, considering equipment location data with other wellsite data, detecting job delays, detecting job delays, providing security for locating well equipment, providing outputs (e.g., displays, reports, alarms, etc.) concerning location and other data, etc.

Figure 7A:
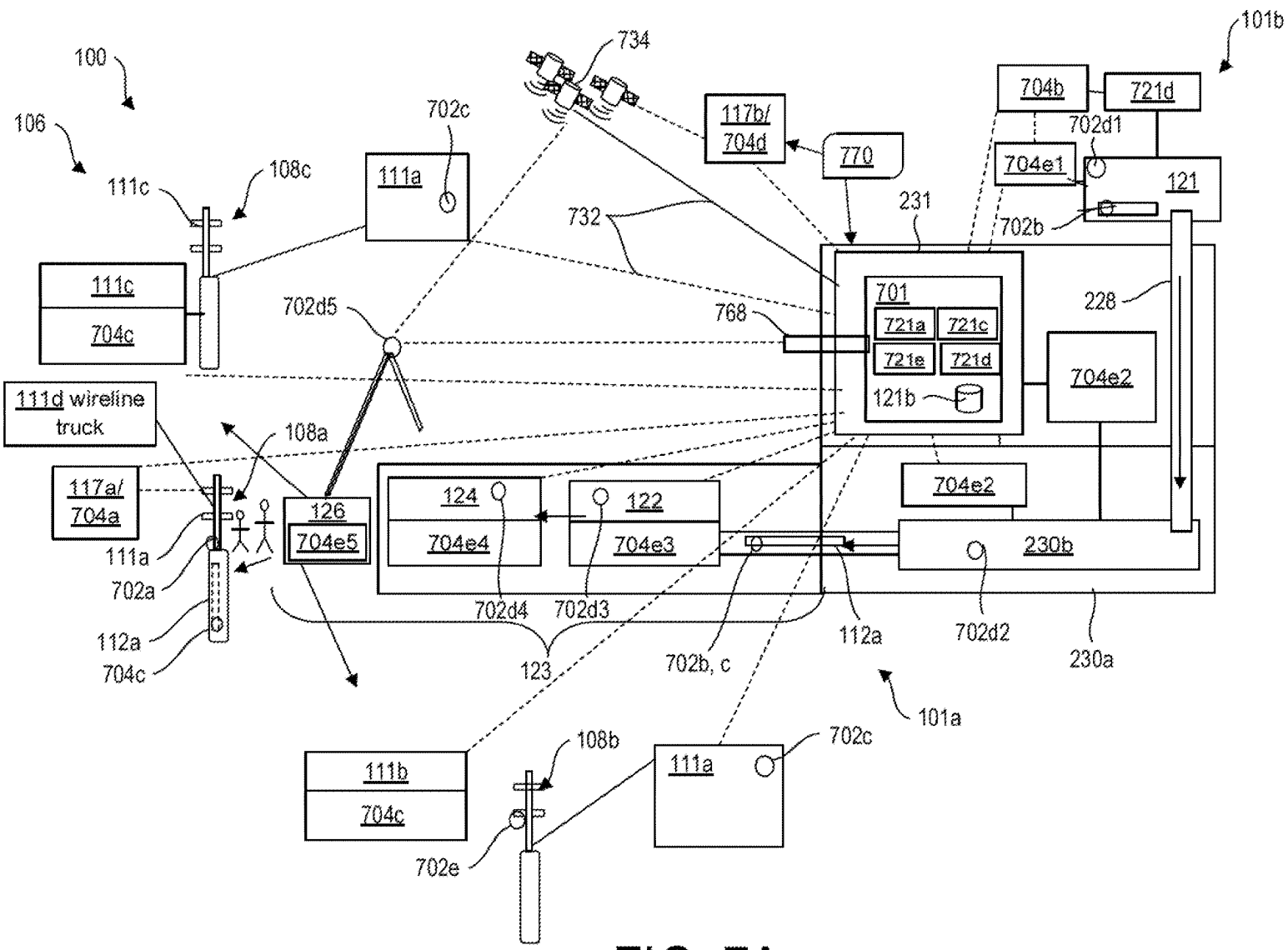
FIG. 7A-7B are schematic diagrams depicting the tool processing system and a wellsite monitoring system positioned about the wellsite.
Figure 7B:
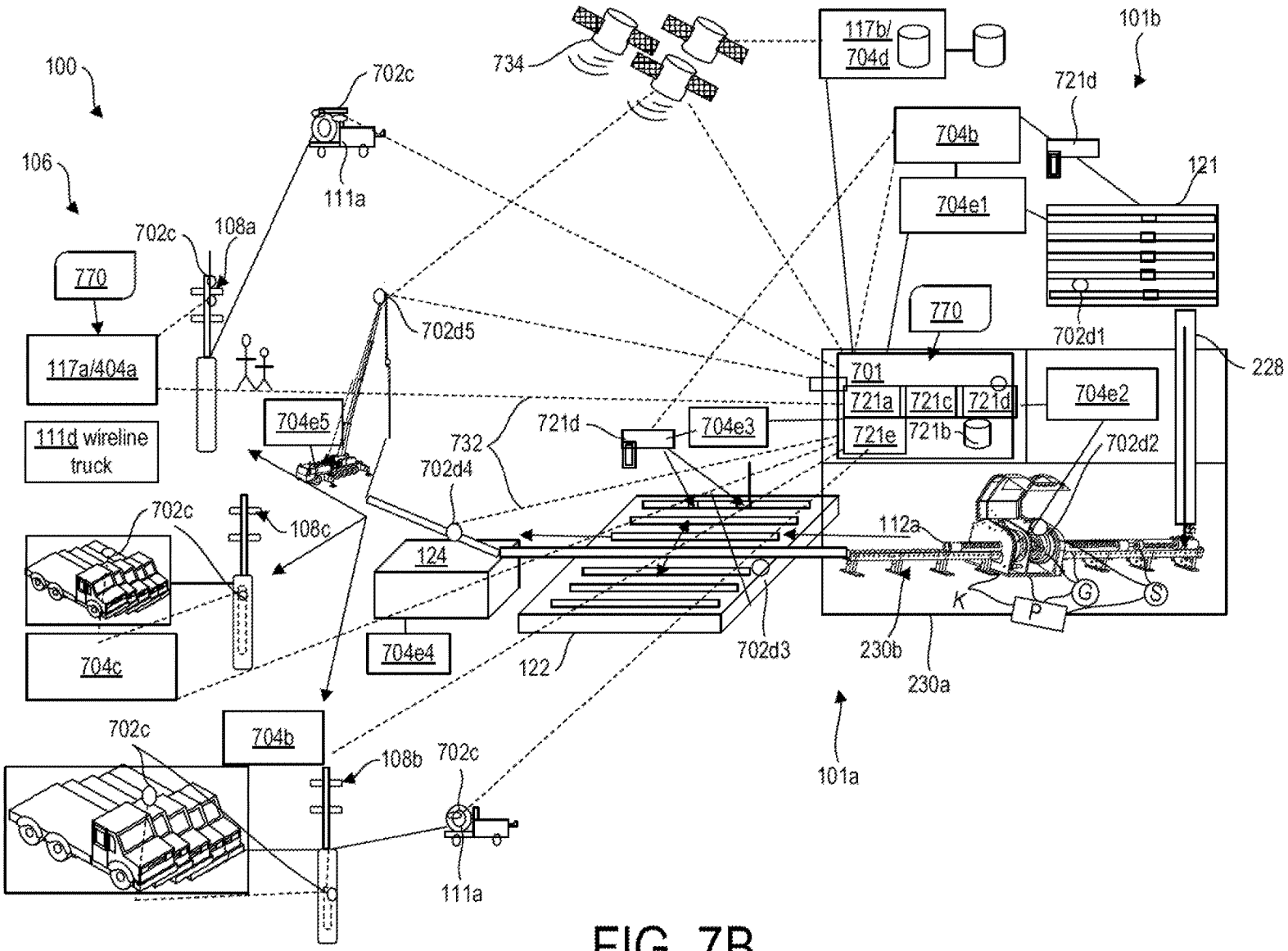

FIG. 7A-7B are schematic diagrams depicting the tool processing system 101*a* and a wellsite monitoring system 101*b* positioned about the wellsite 100. These figures show another view of the tool processing system 101*a* and the wellsite 100 as described in FIGS. 1A and 1B. These figures also show details of the well monitoring system 101*b* in use with the tool processing system 101*a* and the other wellsite equipment 106 at the wellsite 100. While this example depicts use of the wellsite monitoring system 101*b* with specific equipment and configurations, other configurations of the wellsite 100 and/or the wellsite monitoring system 101*b* may be used. Examples of techniques for monitoring that may be used are provided in PCT Application No. PCT/US22/11740, previously incorporated by reference herein.

The wellsite monitoring system 101*b* includes a central station 701, sensors 702*a-d*5, and wellsite monitors 704*a-e*5. The central station 701 is positioned in the assembly facility 230*a*, but may be at other locations about the wellsite 100. The sensors 702*a-d*5 and the monitors 704*a-e*5 are positioned about the wellsite equipment 106 for sensing and processing data from their respective locations about the wellsite. The central station 701 may communicate with the sensors 702*a-d*5 and the monitors 704*a-e*5 to process on one or more portions of the data collected from each of the locations about the wellsite.

The sensors 702*a-d*5, the wellsite monitors 704*a-e*5, and the central station 701 may be communicatively coupled by communication links 732 as schematically indicated by the dotted lines. The communication links 732 may be wired or wireless links used to create a communication network with various onsite or offsite locations. The communication links 732 may extend between any of the devices shown, and may be conveyed directly or via another device. For example, the communication link from the central station 701 may be conveyed by satellites 734 or another monitor 704*a-e*5 to one or more of the other monitors 704*a-e*5.

One or more of the sensors 702*a-d*5 may be positioned about the wellsite 100 for collecting and communicating data concerning the wells 108*a-c*, the downhole tools 112*a-c*, the surface equipment 111, etc. Each of the sensors 702*a-d*5 may include a gauge for measuring data, a memory for storing the data, and/or a processor for processing the data. The sensors 702*a-d*5 may include, for example, a well sensor 702*a*, a tool sensor 702*b*, an equipment sensor 702*c*, and processing sensors 702*d*1-5.

Each of the sensors 702*a-d*5 may be positioned about the wellsite 100 to gather information concerning one or more wellsite parameters. The well sensor 702*a* may be a sensor positioned at the wells 108*a-c* for measuring well parameters concerning operation of the wells 108*a-c*. For example, the well sensor 702*a* may be coupled to the surface equipment 111*a-d* to measure well operating parameters, such as pressures of fluids, detected pumping conditions, detected equipment position, etc. The well sensor 702*a* may also collect well status parameters concerning the well(s) 108*a-c*, such as well location, well identification, equipment type, wellbore conditions, etc. The well sensor 702*b* may also be used to detect well equipment at the well 108*a-c*, such as the well lubricator 241, the wireline tool 112*a*, and the surface equipment 111*a-d*, as well as activity involving the wells 108*a-c*.

The tool sensor (and/or identifier) 702*b* may be positioned, on or about, the tool components 225 and/or the downhole tools 112*a-c*. The tool sensor 702*b* may be attached to one or more of the tool components 225 that are assembled to form the downhole tools 112*a-c*, thereby also acting as the tool sensor 702*b* for the downhole tools 112*a-c* as the tool components 225 and/or the downhole tools 112*a-c* move about the tool processing system 101*a* and/or the wellsite 100. The tool sensor 702*b* may be any device capable of sensing and/or storing information about the tool components 225, the downhole tools 112*a-c*, and/or its surroundings. For example, the tool sensors 702*b* may be provided with gauges capable of measuring environmental conditions, such as temperature, humidity, etc. In another example, the tool sensor 702*b* may be provided with an identifier, such as a bar code, RFID, serial number, etc., capable of providing equipment information about the tool components 225 and/or the downhole tools 112*a-c* (e.g., tool identification, tool type, etc.). The tool sensor 702*b* may optionally be updated at various locations about the wellsite 100, such as after tool assembly at the assembly equipment 230*b*.

The equipment sensor 702*c* may be positioned at various locations about the downhole tool 112*a-c* and wellsite equipment 106 used therewith, such as the winches 111*a*, the injection truck(s) 110*b*, the fracking trucks 110*c*, and/or the wireline truck 110*d*. The equipment sensor 702*c* may include internal and/or external sensors coupled to the downhole tools 112*a-c*, the winches 111*a*, the injection truck(s) 110*b*, the fracking trucks 110*c*, and/or the wireline truck 110*d* for collecting data concerning operation of the downhole tools 112*a-c* and the wellsite equipment 106. For example, the equipment sensor 702*c* may be capable of collecting wireline parameters, such as downhole conditions (e.g., operation logs, time data, perforation data (e.g., time, number, and placement of charges), etc.), winch parameters (e.g., such as weight, length, torque, tension, time, etc.), injection parameters (e.g., such as downhole conditions, pumping pressures, fluid parameters, operation logs, time data, etc.), fracking parameters (e.g., such as downhole conditions, pumping materials, fluid parameters, operation logs, time data, etc.), etc.

The processing sensors 702*d*1-*d*5 may include one or more internal and/or external gauges or other data capture devices positioned about the tool processing system 101*a*. The sensors 702*d*1-*d*5 may include, for example, a storage sensor 702*d*1, an assembly sensor 702*d*2, a staging sensor 702*d*3, a lift sensor 702*d*4, and a transport sensor 702*d*5 for collecting data concerning operation of the processing operations.

The storage sensor 702*d*1 may be positioned about the component storage 121 for collecting storage parameters (e.g., storage location, capacity, storage equipment, storage scheduling, and storage conditions (e.g., humidity, temperature, etc.)), component parameters (e.g., inventory, scheduling, etc. of the tool components 225), and feeder parameters (e.g., feed rate, component position, etc. of the tool feeder 228).

The assembly sensor(s) 702*d*2 may be positioned about the assembly equipment 230*b* and/or the loader 237 for collecting assembly parameters, such as component intake parameters (e.g., feed rate, positioning, capacity, intake rate, etc.), connection parameters (e.g., torques, drive rates, position, threading, etc.), and outtake parameters (e.g., outtake rate, positioning, capacity, etc.). As shown in FIGS. 4C and 4D, the assembly sensor 702*d*2 may include a sensor S, a gauge G, a camera C, or other devices capable of collecting data about the assembly equipment 230*b* and/or the loader 237.

Referring back to FIG. 7A, the staging sensor 702*d*3 may be positioned about the tool stager 122 for collecting staging parameters, such as component storage parameters (e.g., storage location, capacity, storage equipment, storage scheduling, etc.), storage conditions (e.g., humidity, temperature, etc.), scheduling parameters (e.g., sequencing, order, delivery, etc.), and conveyor parameters (e.g., intake rate, transfer rate, outtake rate, tool positioning/location, capacity, etc.).

The lift sensor 702*d*4 may be positioned about the tool lift 124 for collecting lift parameters, such as motion parameters (e.g., lift angle, torques, drive rates, position, etc.) and motion parameters (e.g., outtake rate, positioning, capacity, etc.), and conveyor parameters (e.g., intake rate, transfer rate, outtake rate, tool positioning/location, capacity, etc.).

The transport sensor(s) 702*d*5 may be positioned about the tool transporter 126 for collecting transport parameters, such as attachment parameters (e.g., position, locking, equipment ID, etc.), transfer parameters (e.g., intake rate, outtake rate, speed, etc.), and location parameters (e.g., spatial location, time/date, delivery address, etc.). This wellsite tracker 702*a* may be positioned at various locations about the transporter 126 and/or the well equipment 106 carried by the transporter 126. For example, the wellsite tracker 702*a* may be located about the vehicle 124*a*, the boom 124*b*, the hoist 124*c*, the lubricator 241, the wireline tool 112*a* carried by the transporter 126, etc. As shown in FIG. 3A, the transport sensor 702*d*5 may be, for example, a well tracker T with GPS location and other capabilities.

The wellsite tracker 702*a* may also be positioned about the wellsite 100 to track movement of equipment, personnel, etc. The wellsite tracker 702*a* may be provided with capabilities for collecting and storing transporter parameters (e.g., spatial location, time, etc.) concerning the transporter 126, the well equipment 106 carried by the transporter, the wells 108*a-c*, or other aspects of the wellsite 100. An example well tracker that may be used is described in PCT Application No. PCT/US22/11740, previously incorporated by reference herein.

One or more wellsite monitors 704*a-e*5 may be positioned about the wellsite 100 for processing the data collected by the sensors 702*a-d*5. The wellsite monitors 704*a-e*5 may include, for example, a well monitor 704*a*, a tool monitor 704*b*, an equipment monitor 704*c*, an offsite monitor 704*d*, and processing monitors 704*e*1-*e*5.

Each of the monitors 704*a-e*5 may include various processor components 721*a-d*, such as communicators (e.g., transceivers, antennas, etc.) 721*a* capable of sending/receiving signals, a database (e.g., memory) 721*b* capable of storing data, controllers (e.g., central processing units (CPUs), processors, etc.) 721*c* capable of processing the data, input/output (I/O) devices 721*d* (e.g., scanners, keyboards, touchscreens, monitors, printers, displays, etc.) capable of inputting data and generating outputs (e.g., displays, reports, alarms, etc.), computer readable medium 721*e* (e.g., software) capable of processing data and/or operating equipment, and other processor components. For simplicity, the processor components 721*a-d* are only shown in FIGS. 7A-7B as being positioned in the central station 701, but may also be included in one or more of the monitors 704*a-e*5.

The well monitor 704*a* may be coupled (wirelessly or by wire) to the well sensor(s) 702*a* for collecting data from the well sensor(s) 702*a*. The well monitor 704*a* may be used for collecting and processing the data received from these well sensors 702*a*. For example, the well monitor 704*a* may generate well parameters about the wells 108*a-c*, such well identification, equipment identification, crew identification, well location, operating parameters, etc. The equipment monitor 704*b* may also generate outputs, such as job logs, equipment schedules, crew assignments, maintenance needs, etc. The well monitor 704*a* may be part of, or coupled to, the surface unit 117*a*. The well monitor 704*a* may be a separate unit that works as a stand-alone system, or as an integral part of the surface unit 117*a*.

The tool monitor 704*b* may be coupled (wirelessly or by wire) to the tool sensor(s) 702*b* for collecting data from the tool sensor(s) 702*b*. The tool monitor 704*b* may be used for processing the data received from the tool sensors 702*b*. For example, the tool monitor 704*b* may generate tool parameters about the tool components 225, such identification, specifications, assigned location, operating parameters, etc. The tool monitor 704*b* may also generate outputs, such as tool inventories, equipment schedules, maintenance needs, etc.

The tool monitor 704*b* may include or be coupled to an input/output device 721*d*, such as a scanner (e.g., stationary or mobile scanner, scanning gun, etc.). The scanner 721*d* may be used, for example, for scanning the tool sensor 702*d*1 information about the tool components 225 into the equipment monitor 704*b*. Information may also be manually entered into the tool monitor 704*b*. Based on the collected tool data, the equipment monitor 704*b* may generate outputs, such as equipment schedules, equipment logs, client specs, etc.

The equipment monitors 704*c* may be positioned about various wellsite equipment 106, such as the winches 111*a*, the downhole tools 112*a-c*, the injection equipment 111*b*, the fracking equipment 111*c*, and/or the wireline truck 11*d*. The equipment monitors 704*c* may be coupled to the equipment sensors 702*c* for collecting and processing data received from the equipment sensors 702*c*. For example, the equipment monitor 704*c* may be coupled wirelessly and/or by the conveyance 109*c* to the equipment sensor 702*c* positioned in the downhole wireline tool 112*a*. The equipment monitors 704*c* may generate various parameters from the equipment sensors 702*c*, such as winch parameters about the winch 111*a* (e.g., tension, length, time, etc.), wireline parameters about the wireline tool 112*a* (e.g., serial numbers, model numbers, downhole measurements, wellbore conditions, job time, etc.), injection parameters about the injection equipment 110*b* (e.g., pumping pressure, fluid pressure, etc.), fracking parameters about the fracking equipment 110*c* (e.g., the fluid flow rate, pressures, etc.), and wireline parameters about the wireline truck 110*d* (e.g., perforations, depth, location, etc.). The equipment monitors 704*c* may also generate outputs, such as job logs, perforation timing, number and location of perforations, etc.

The offsite monitor 704*d* may be positioned at the offsite unit 117*b*. The offsite monitor 704*d* may be coupled to one or more of the sensors 702*a-d*5 and/or the other monitors 704*a-e*5 to collect data therefrom. The offsite monitor 704*d* may also be coupled to other sources, such as a library 770, to receive data therefrom. The offsite monitor 704*d* may collect generate wellsite parameters about the wellsite 100, customers (e.g., client data), the company operating the wellsite 100, historical data, etc. The offsite monitor 704*d* may also generate outputs, such as schedules, reports, comparisons, alarms, etc.

The processing monitors 704*e*1-*e*5 include a storage monitor 704*e*1, an assembly monitor 704*e*2, a staging monitor 704*e*3, a lift monitor 704*e*4, and a transport monitor 704*e*5 positioned about the component storage 121, the assembly facility 230*a*, the assembly equipment 230*b*, the tool stager 122, the tool lift 124, the tool transporter 126, respectively. The various monitors 704*e*1-*e*5 may be positioned with, or a distance from, their respective wellsite equipment 106. The processing monitors 704*e*1-*e*5 may be used for collecting and processing data received from the sensors 702*a*-*d*5. The monitors 704*e*1 may also be coupled to the input/output device (scanner) 721*d* for receiving scanned tool data therefrom. The monitors 704*e*1-*e*5 may also generate outputs, such as equipment schedules, equipment logs, client specs, etc.

The central station 701 may be positioned at various locations about the tool processing system 101*a* and/or the wellsite 100 for collecting data from one or more of the sensors 702*a*-*d*5 and/or from one or more of the other monitors 704*a*-*e*5. As shown in FIGS. 7A and 7B, the central station 701 may be positioned in the assembly facility 230*a* (mobile trailer) at the wellsite with the tool assembly 120. While the central station 701 is shown positioned about the assembly facility 230*a*, the central station 701 may be positioned in any location about the wellsite.

The central station 701 may be coupled (wirelessly or by wire) by one or more of the communication links 732 to the sensors 702*a*-*d*5 and the well monitors 704*a*-*e*5. In this position, the central station 701 is able to send and receive raw and/or processed data from these multiple sources. The central station 701 is also able to generate complex outputs based on these multiple sources, such as schedules, reports, comparisons, alarms, etc., and to monitor, control. The central station 701 is also able to operate the assembly equipment 230*b* and/or other wellsite equipment 106 from the operator station 231 within the assembly facility 230*a*.

The central station 701 may act as a monitor for other of the well sensors 702*a*-*d*5 and/or the well monitors 704*a*-*e*5. For example, the well monitor 704*a* may be coupled to the transporter sensors 702*d*5 and/or the transporter monitor 704*e*5. The transporter sensors 702*d*5 may be wellsite trackers with GPS location tracking capabilities for sending data via antenna 768 to the central station 701. These wellsite tracker(s) 702*d*5 may send signals directly to the central station 701 (and/or the transporter monitor 704*e*5) at intervals (e.g., ping every 30 seconds) to identify any changes in location. The central station 701 may then determine location information concerning the equipment carried by the transporter 126, and confirm the transporter operation. Techniques for tracking are described in PCT Application No. PCT/US22/11740, previously incorporated by reference herein.

The various monitors 704*a*-*e*5 may be integrated with, or coupled to, other monitors 704*a*-*e*5 about the wellsite 100. The various monitors 704*a*-*e*5 may be integrated with, or coupled to, the surface unit 117*a*, the offsite unit 117*b*, the libraries 770, etc. The monitors 704*a*-*e*5 may also be coupled to the sensors 702*a*-*f*, the input/output device (scanner) 721*d*, and/or other devices for operation therewith. Examples of monitors and monitoring techniques that may be used is described in PCT Application No. PCT/US22/11740, previously incorporated by reference herein.

While FIGS. 7A-7B show an example layout for the wellsite 100 and the wellsite monitoring system 101*b*, variations are within the scope of this disclosure. The monitoring system 101*b* may be positioned about any wellsites 100 with a variety of wells 108*a*-*c* and/or wellsite equipment 106. The wellsite monitoring system 101*b* may include one or more of the sensors 702*a*-*d*5, monitors 704*a*-*e*5, communication links 732, and/or one or more surface/offsite units 117*a,b*, as well as other sensors 702*a*-*d*5, monitors 704*a*-*e*5, etc., at various locations. One or more of the monitors 704*a*-*e*5 may also be combined or coupled together for communication therebetween. One or more of the sensors 702*a*-*d*5 may also be provided with an internal monitor (not shown) and/or capabilities for monitoring. The communication link 732 may extend directly from the sensors 702*a*-*d*5 to the central station 701, and/or from the sensors 702*a*-*d*5 to the one or more of the other monitors 704*a*-*d*5.

In an example, the sensors 702*a*-*e*5 may be used to collect processing data concerning the tool processing system 101*a*. The processing data may include, for example, tracking data collected from a well tracker T concerning position of certain of the tool processing system 101*a*, such as the transporter 126. The tracking data may include, for example, position over time of the transporter 126 to confirm the location of the transporter 126. This information may be collected and analyzed by the monitors 704*a*-*e*5 and/or the central station 701 to generate tracking and/or processing analysis. The tracking data may be combined with other data collected and/or analyzed by the monitors 704*a*-*e*5, and further processed by the central station 701. In this manner, the monitoring system 101*b* may be used to monitor the location of equipment, such as portions of the processing system 101*a* and/or the tools 112*a*-*c* processed thereby. This information may be used, for example, to facilitate movement of the downhole tools 112*a*-*c* about the processing system 101*a* and/or the wellsite 100. The processing system 101*a* may be operated by the central station 701 based on the analysis. The downhole tools 112*a*-*c* and the equipment may be operated and processed at the central station 701 based on the collected processing and/or wellsite data, analysis, and/or further analysis.

Figure 8:
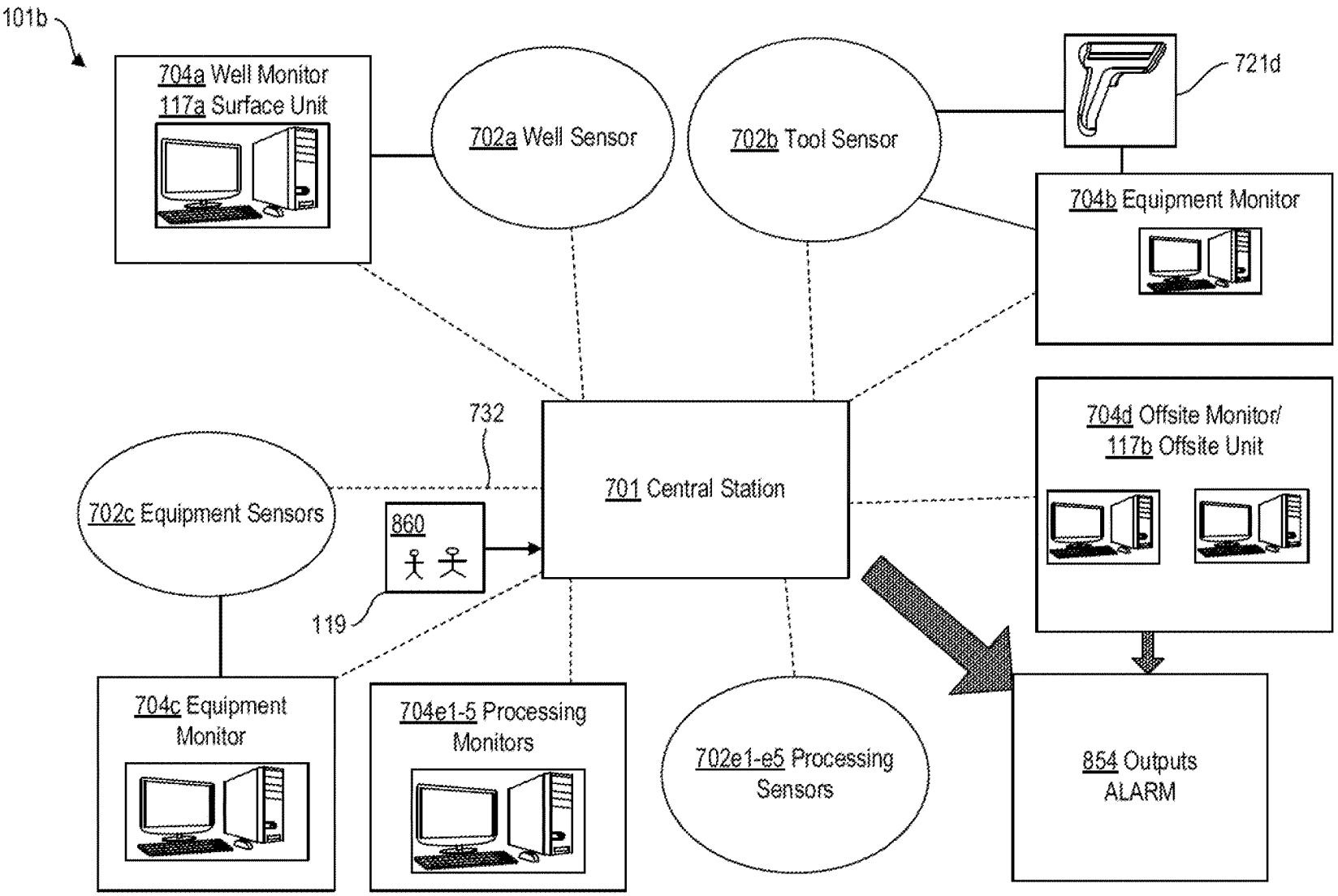
FIG. 8 is a schematic diagram depicting the wellsite monitoring system performing multiple well operations.

FIG. 8 is a schematic diagram of the wellsite monitoring system 101*b* for performing multiple wellsite operations. As shown in this view, the central station 701, the multiple sensors 702*a*-*e*5, and the multiple monitors 704*a*-*e*5 may be used to integrate captured data and analyze wellsite operations. As also shown in this view, the wellsite monitors 704*a*-*e*5 may be independent components, or combined with other equipment, such as the central station 701, the surface unit 117*a* and/or offsite unit 117*b*. While not shown, one or more of the monitors 704*a*-*d*5 may optionally be part of or coupled to another monitor, such as the equipment monitors 704*c* located in the wireline truck 110*d* (FIG. 1B).

In the example in FIG. 8, the central station 701, the various sensors 702*a*-*d*5 and the wellsite monitors 704*a*-*e*5 are interconnected by the communication links 732 to allow cross communication therebetween. The data from the various sensors 702*a*-*d*5 may be combined within one or more of the wellsite monitors 704*a*-*e*5 to generate various outputs 854. One or more of the wellsite monitors 704*a*-*e*5 may be used to manipulate the data collected by one or more of the various sensors 702*a*-*d*5 and/or one or more external sources, such as one or more onsite and/or offsite libraries 770 (FIG. 7A), as well as information that may be input 860 by the crews 119 at the central station 701, by scanner 721*d*, and/or at one or more of the monitors 704*a*-*e*5. The combination of sources provides the ability to combine location data from the sensors 702*a*-*d*5 with other data to provide outputs based on the data collected by the monitors 704*a*-*e*5. The various data may be combined and analyzed across multiple sources to provide the ability to analyze various combinations of information about operations.

For example, the wellsite monitoring system 101*b* may be used to generate outputs based on a combination of data from the wellsite trackers 702*d*5 and/or the other sensors 702*a-d*4. One or more of the well monitor(s) 704*a-e*5 may combine the location data with the various data to generate the location-based outputs concerning the processing of the downhole tools 112*a-c*. For example, the locations generated over time by the wellsite trackers 702*a* can be combined with wireline data and fracking data to assure proper placement of equipment and to determine delays in operations. This location detection may also identify missing, lost, and/or stolen equipment to assure security of equipment use and placement, as well as identifying unusual operational events and/or costly delays.

Figure 9:
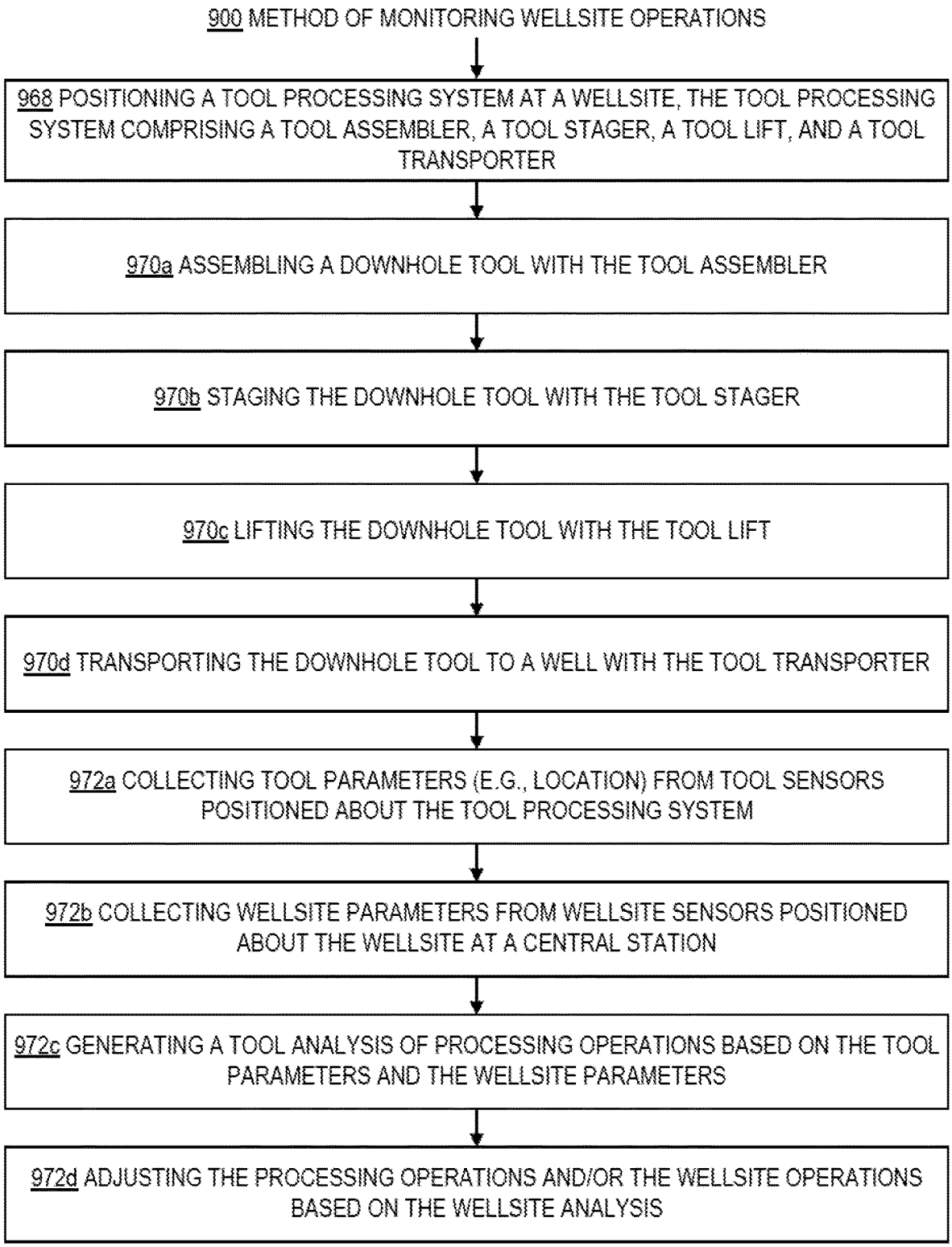
FIG. 9 is a flow chart depicting a method of monitoring wellsite operations.

FIG. 9 is a flow chart depicting a method 900 of monitoring wellsite operations. The method 900 involves (968) positioning a tool processing system at a wellsite, the tool processing system comprising a tool assembler, a tool stager, a tool lift, and a tool transporter, (970*a*) assembling a downhole tool with the tool assembler, (970*b*) staging the downhole tool with the tool stager, (970*c*) lifting the downhole tool with the tool lift, and (970*d*) transporting the downhole tool to a well with the tool transporter. The method may also involve storing tool components. The method 900 further involves (972*a*) collecting tool parameters (e.g., location) from tool sensors positioned about a tool processing system, (972*b*) collecting wellsite parameters from wellsite sensors positioned about the wellsite at a central station, (972*c*) generating a tool analysis of processing operations based on the tool parameters and the wellsite parameters, and (972*d*) adjusting the processing operations and/or the wellsite operations based on the wellsite analysis.

Part or all of the method may be performed in any order, or as needed. Part or all of the methods herein may be performed using hardware (e.g., processors), software (e.g., computer readable medium (transitory or non-transitory)), and or the monitors described herein.

As used herein, "computer readable medium" or "machine-readable storage medium" may include a storage drive (e.g., a hard drive), flash memory, Random Access Memory (RAM), any type of storage disc (e.g., a Compact Disc Read Only Memory (CD-ROM), any other type of compact disc, a DVD, etc.) and the like, or a combination thereof. In some examples, a storage medium may correspond to memory including a volatile (main) memory, such as RAM, where software may reside during runtime, and a secondary memory. The secondary memory can, for example, include a non-volatile memory where a copy of software or other data is stored.

As provided above, examples in the present disclosure may also be directed to a non-transitory computer-readable medium storing computer-executable instructions and executable by one or more processors via which the computer-readable medium is accessed. A computer-readable media may be any available media that may be accessed by a computer. By way of example, such computer-readable media may include random access memory (RAM), read-only memory (ROM), electrically erasable programmable read-only memory (EEPROM), compact disk read-only memory (CD-ROM) or other optical disk storage, magnetic disk storage or other magnetic storage devices, or any other medium that may be used to carry or store desired program code in the form of instructions or data structures and that may be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers.

Note also that the software implemented aspects of the subject matter claimed below are usually encoded on some form of program storage medium or implemented over some type of transmission medium. The program storage medium is a non-transitory medium and may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The claimed subject matter is not limited by these aspects of any given implementation.

Furthermore, examples disclosed herein may be implemented by hardware, software, firmware, middleware, microcode, hardware description languages, or any combination thereof. When implemented in software, firmware, middleware or microcode, the program code or code segments to perform the necessary tasks (e.g., a computer-program product) may be stored in a machine-readable medium. A processor(s) may perform the necessary tasks.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "upper", "down," "lower", "top", "bottom", "anterior" and "posterior" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features and/or methods provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter. For example, while certain tools and components (e.g., assemblies) are provided herein, it will be appreciated that various configurations (e.g., shape, order, orientation, etc.) of such tools and/or components may be used. While the figures herein depict a specific configuration or orientation, these may vary. First and second are not intended to limit the number or order.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. An integrated tool processing system for processing a downhole tool at a wellsite, the integrated tool processing system comprising:

a tool assembler comprising assembly equipment positioned at the wellsite, the assembly equipment comprising a tool conveyor and a gun builder positioned along the tool conveyor, the gun builder comprising gun chucks to threadedly connect portions of the downhole tool together;

a tool lift operatively connected by a tool stager to the tool assembler, the tool stager comprising a staging conveyor connected between the tool conveyor and the tool lift to transfer the downhole tool therebetween, the tool lift comprising a lift base to receive the downhole tool and a lift arm, the lift arm movably positionable at an angle to the lift base whereby the downhole tool is lifted about the lift base; and a tool transporter comprising a vehicle positionable about the wellsite and a boom extending above the vehicle, the boom positionable about the lift arm and connectable to the downhole tool, the vehicle and the boom carrying the downhole tool into position for delivery at the wellsite.

2. The integrated tool processing system of claim 1, further comprising a tool storage operatively connected to the tool assembler, the tool storage comprising a storage container to store portions of the downhole tool and a feeder, the feeder coupled to the tool conveyor to deliver the portions of the downhole tool to the tool assembler.

3. The integrated tool processing system of claim 1, further comprising a loader operatively connected to the tool assembler, the loader comprising a platform, a frame, and a driver, the driver movably positionable about the frame, the drive having a gripper to releasably support the portions of the downhole tool.

4. The integrated tool processing system of claim 1, wherein the tool stager is operatively connected to the tool conveyor, the tool stager comprising a staging conveyor to receive the downhole tool from the tool assembler.

5. The integrated tool processing system of claim 4, wherein the tool stager further comprises a staging storage and a sorter.

6. The integrated tool processing system of claim 1, further comprising a monitoring system comprising wellsite sensors positioned about the wellsite to collect data, monitors positioned about the wellsite to process the data from the wellsite sensors, and a central processing unit centrally located about the wellsite to process data from multiple monitors.

7. The integrated tool processing system of claim 6, wherein the wellsite sensors comprise a wellsite tracker, the wellsite tracker comprising a global positioning satellite sensor.

8. The integrated tool processing system of claim 1, wherein the tool assembler comprises an assembly facility, the assembly facility comprising a housing with an operations room for electronic equipment and an assembly room for the assembly equipment, the operations room separated from the assembly room by a barrier.

9. A wellsite monitoring system for monitoring wellsite equipment at a wellsite, the wellsite monitoring system comprising:

wellsite sensors positioned about the integrated tool processing system of claim 1 to collect wellsite data;

wellsite monitors positioned about the wellsite, the wellsite monitor coupled to the wellsite sensors to receive wellsite data therefrom, the wellsite monitors comprising monitor processors to generate monitor outputs based on the wellsite data; and a central station positioned at the wellsite, the central station coupled to the wellsite monitors to receive the wellsite data and the monitor outputs therefrom, the central station comprising a central processor to generate central outputs based on the monitor outputs and the wellsite data.

10. The wellsite monitoring system of claim 9, wherein the wellsite monitors further comprise a monitor communicator, a memory, an input/output device, and a computer readable medium.

11. The wellsite monitoring system of claim 9, wherein the wellsite sensors comprise a wellsite tracker.

12. The wellsite monitoring system of claim 9, wherein the wellsite sensors comprise a well sensor, an equipment sensor, a wireline sensor, an injection sensor, and combinations thereof.

13. The wellsite monitoring system of claim 9, wherein the wellsite monitors are coupled together by communication links.

14. A method of monitoring wellsite operations at a wellsite, the method comprising:

collecting tool parameters from tool sensors positioned about the integrated tool processing system of claim 1;

collecting wellsite parameters from wellsite sensors positioned about wellsite equipment at the wellsite;

generating a tool analysis of processing operations based on the tool parameters, the tool analysis comprising a location of the downhole tool over time;

generating a wellsite analysis based on the tool parameters and the wellsite parameters; and performing processing operations based on the wellsite analysis.

15. The method of claim 14, wherein the tool sensors comprise a well tracker and wherein the collecting tool parameters comprises collecting location parameters from a wellsite tracker; and adjusting the processing operations based on the tool analysis.

16. The method of claim 15, wherein the collecting comprises using the wellsite tracker, receiving location data from satellites as portions of the tool processing system move about the wellsite, and wherein the generating comprises inferring tracking data for the portions based on the location data over time, the tracking data comprising spatial location and the time of the portions and confirming the portions by comparing the tracking data for the portions with predetermined specifications.

17. The method of claim 14, further comprising adjusting the processing operations based on the tool analysis.

18. The method of claim 14, further comprising generating outputs from the tool analysis.

19. The method of claim 18, wherein the outputs comprise maps, charts, reports, analysis, alarms, feedback, control decisions, and combinations thereof.

20. The method of claim 18, wherein the generating comprises generating an alarm when the tool parameters are outside of a predetermined range of predetermined specifications.

21. The method of claim 14, further comprising confirming the wellsite operations by comparing the tool parameters with predetermined wellsite specifications.

22. A method of processing downhole tools for use at a wellsite, the method comprising:

assembling a downhole tool by:

passing portions of the downhole tool along an assembly conveyor and into a gun builder; and threadedly connecting the portions of the downhole tool using the gun builder;

passing the downhole tool from the gun builder to a tool lift by passing the downhole tool from the assembly conveyor to the tool lift via a tool stager;

lifting the downhole tool at an angle using the tool lift; and transporting the downhole tool from the tool lift to locations about the wellsite.

* * * * *